US007526214B2

(12) United States Patent
Asaba

(10) Patent No.: US 7,526,214 B2
(45) Date of Patent: Apr. 28, 2009

(54) IMAGE FORMING DEVICE

(75) Inventor: Takeshi Asaba, Tokyo (JP)

(73) Assignee: Oki Data Corporation, Tokyo (JP)

( * ) Notice: Subject to any disclaimer, the term of this patent is extended or adjusted under 35 U.S.C. 154(b) by 492 days.

(21) Appl. No.: 11/188,758

(22) Filed: Jul. 26, 2005

(65) Prior Publication Data

US 2006/0018672 A1 Jan. 26, 2006

(30) Foreign Application Priority Data

Jul. 26, 2004 (JP) ..... 2004-217454

(51) Int. Cl.
*G03G 15/00* (2006.01)

(52) U.S. Cl. ..... 399/21; 399/18

(58) Field of Classification Search ..... 399/21, 399/18

See application file for complete search history.

(56) References Cited

U.S. PATENT DOCUMENTS 4,969,009 A * 11/1990 Sugiyama et al. ..... 355/64
5,887,228 A * 3/1999 Motohashi et al. ..... 399/111
5,897,244 A * 4/1999 Miyazaki et al. ..... 399/122
5,974,290 A * 10/1999 Inoue ..... 399/124
6,549,741 B2 * 4/2003 Miura ..... 399/124
7,076,187 B2 * 7/2006 Jeong et al. ..... 399/110
7,162,182 B2 * 1/2007 Tonges et al. ..... 399/110

FOREIGN PATENT DOCUMENTS

JP 8-151166 6/1996

* cited by examiner

*Primary Examiner*—Anthony H. Nguyen
(74) *Attorney, Agent, or Firm*—Kubotera & Associates, LLC

(57) ABSTRACT

An image forming device includes a data receiving unit for receiving printing data and first identification information through a network; a data storage unit for storing the printing data and the first identification information; a non-contact medium information obtaining unit for obtaining second identification information stored in a memory of a non-contact medium; a print control unit for controlling a printing process of forming an image according to the printing data; a information comparison unit for comparing the first identification information with the second identification information; and a data control unit for retrieving the printing data corresponding to the first identification information from the data storage unit and sending the printing data to the print control unit when the information comparison unit determines that the first identification information matches to the second identification information.

16 Claims, 17 Drawing Sheets

IMAGE FORMING DEVICE

BACKGROUND OF THE INVENTION

The present invention relates to an image forming device such as a printer capable of automatic duplex printing.

In a conventional image forming device of an electric photography type such as a printer, a copier, and a facsimile, a plurality of image forming units is arranged along a medium transporting member in a direction that the medium transporting member transports a medium, and the medium transporting member transports the medium to the image forming units. Each of the image forming units is provided with a detachable print process cartridge for forming a toner image.

The print process cartridge includes a photo-sensitive member for forming an image on a surface thereof; a charging unit for charging the photo-sensitive member; a developing unit for attaching toner on a static latent image on the surface of the photo-sensitive member; a cleaning unit for cleaning remaining toner on the surface of the photo-sensitive member; a toner cartridge for supplying toner to the developing unit; and a drive transmitting unit for driving the charging unit, the photo-sensitive member, and the developing unit.

Each of the image forming units includes an exposing unit for exposing the surface of the photo-sensitive member to form the static latent image on the surface of the photo-sensitive member. The developing unit of the print process cartridge includes a developing roller for pressing the surface of the photo-sensitive member and attaching toner to the static latent image to form a toner image; a toner supply roller for supplying the toner received from the toner cartridge to the developing roller. A transfer unit is disposed to face each of the image forming units for transferring the toner image on the photo-sensitive member to a recording medium while transporting the recording medium.

Each of the image forming units further includes a fixing unit for fixing the toner image transferred at the transfer unit while transporting the recording medium. The fixing unit includes a heat roller for heating and transporting the recording medium, and a pressure roller for pressing the recording medium against the heat roller. A duplex transport path is provided for transporting the recording medium toward a downstream side of the photo-sensitive member in a transport direction to transfer another toner image on the photo-sensitive member after the fixing unit fixes the toner image.

When the image forming device performing the duplex printing to a plurality of media, while a first sheet is transported in a switchback path, a next sheet and a sheet after the next sheet are transported and printed in the image forming device concurrently.

When a sheet is jammed during transportation, in an image forming device disclosed in Japanese Patent Publication No. 08-151166, a housing is divided into an upper housing and a lower housing (device main body), so that the upper housing is opened around a hinge mechanism disposed on a side surface of the lower housing to remove the jammed sheet. That is, after a sheet transport path is opened, the jammed sheet in the sheet transport path is identified and removed. Accordingly, after the sheet transport path is opened, it is necessary to move a part of the sheet transport path so that an operator can find the jammed sheet, thereby making the operation troublesome.

In view of the problem described above, an object of the present invention is to provide an image forming device, in which it is possible to easily remove a jammed sheet.

Further objects and advantages of the invention will be apparent from the following description of the invention.

SUMMARY OF THE INVENTION

In order to attain the objects described above, according to the present invention, an image forming device comprises a transport path formed of a plurality of structural members connected with each other; a plurality of jam detection devices disposed at proper locations along the transport path; and a dividing and opening control device for dividing and opening the transport path according to a location where a jam occurs when one of the jam detection devices detects the jam, so that the jam is recovered at the location.

In the invention, when a jam occurs during printing, one of the jam detection devices detects a location of the jam in the transport path. The dividing and opening control device divides and opens the transport path, so that the jam is easily recovered at the location. Accordingly, it is possible to easily identify the jammed sheet and recover the jam.

DETAILED DESCRIPTION OF PREFERRED EMBODIMENTS

Hereunder, embodiments of the present invention will be explained with reference to the accompanying drawings. An image forming device includes a plurality of structural members with a same rotational center, so that the structural members can be divided and opened in a same rotational direction. Further, the image forming device includes a dividing and opening device formed of a link for connecting the structural members to be slidable and an electromagnetic clutch for controlling the structural members to slide, thereby reducing the number of parts.

First Embodiment

Figure 1:
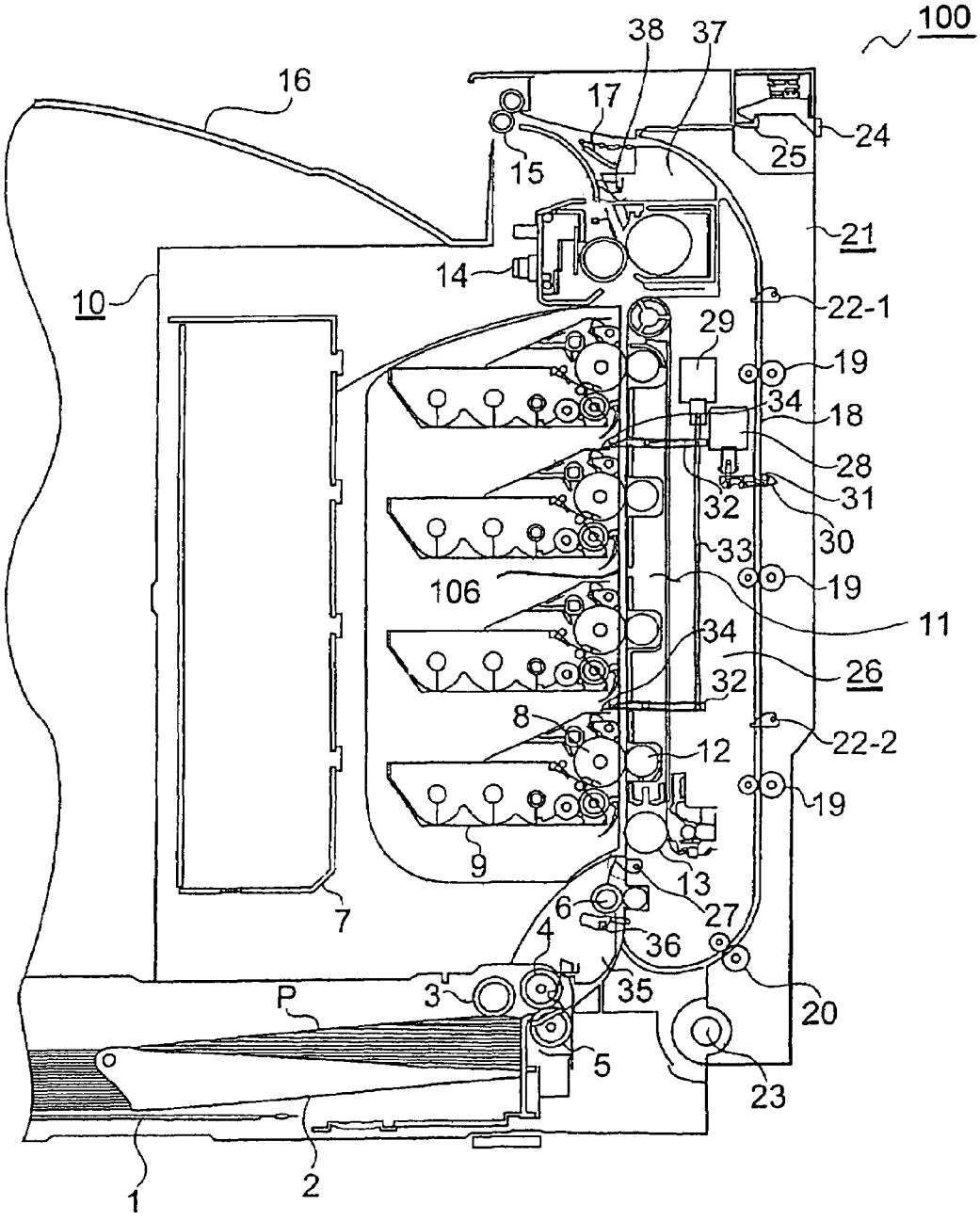
FIG. 1 is a sectional view showing an image forming device according to a first embodiment of the present invention.

FIG. 1 is a sectional view showing an image forming device 100 according to a first embodiment of the present invention. The image forming device 100 includes a cassette 1 for storing printing sheets P; a sheet supply auxiliary roller 3; a sheet supply roller 4; a printing sheet receiving plate 2 for pressing the printing sheet P against the sheet supply auxiliary roller 3 and the sheet supply roller 4; a separation roller 5 for separating the printing sheets P transported with the sheet supply auxiliary roller 3 and the sheet supply roller 4; and a resist roller 6 for correcting skew of the printing sheet P and transporting the printing sheet P to a transfer belt 11.

The image forming device 100 further includes an exposure device 7 for irradiating a laser beam; a plurality of photo-sensitive drums 8 for receiving the laser beam of the exposure device 7 to form a static latent image; a plurality of developing units 9 for attaching toner to the static latent image formed on surfaces of the photo-sensitive drums 8 with the laser beam of the exposure device 7; a frame 10 for positioning the developing units 9 to be detachable; and the transfer belt 11 for transferring the image to the printing sheet P transported from the photo-sensitive drums 8. The transfer belt 11 includes a plurality of transfer rollers 12 disposed therein and facing the photo-sensitive drums 8, respectively. Accordingly, the frame 100 is provided with an image forming transport path 106 between the photo-sensitive drums 8 and the transfer belt 11 for transporting the printing sheets P.

The image forming device 100 further includes a fixing device 14 for fixing the toner image transferred on the printing sheet P with the transfer belt 11 while transporting the printing sheet P; a discharge roller 15 for transporting the printing sheet P passing through the fixing device 14; a discharge tray 16 for stacking the printing sheet P transported from the discharge roller 15; a sheet guide 35 disposed on the frame 10 between the sheet supply roller 4 and the resist roller 6; a sheet guide 37 disposed at a downstream side of the fixing device 14 for guiding the printing sheet P from the fixing device 14 to a transport path switching guide 17. The sheet guide 35 is provided with a sensor 36 for detecting the printing sheet P moving toward the resist roller 6. The sheet guide 37 is also provided with a sensor 38 for detecting the printing sheet P transported from the fixing device 14.

The image forming device 100 further includes a duplex transport path 18 for transporting the printing sheet P switched back with the discharge roller 15 rotating in reverse during duplex printing. The duplex transport path 18 is provided with a plurality of transport rollers 19 and a sheet re-supply roller 20 for transporting the printing sheet P to the resist roller 6 one more time. The duplex transport path 18 is also provided with a sheet guide 21*a* disposed on a first structure member 21 situated outside the device. The first structure member 21 is provided with the discharge rollers 19, and sensors 22 (22-1 and 22-2) for detecting the printing sheet P in addition to the sheet guide 21*a*.

The first structural member 21 is supported on the frame 10 with a rotational pivot 23. A handle 24 disposed at an upper portion of the first structural member 21 engages a protrusion 25 disposed on the frame 10 to fix the first structural member 21. The duplex transport path 18 has a sheet guide 26*a* disposed on a second structural member 26 situated inside the device. The second structure member 26 is provided with the transfer belt 11 in addition to the sheet guide 26*a*. The second structural member 26 is supported on the frame 10 with the rotational pivot 23, and is fixed and sandwiched between the first structural member 21 and the developing units 9 having the photo-sensitive drums 8.

The second structural member 26 has solenoids 28 and 29 and a sensor 27 for detecting the printing sheet P. When the solenoid 28 moves reciprocally, a latch 30 rotates, so that the second structural member 26 engages or disengages from a boss 31 disposed on the first structural member 21, thereby connecting or opening the first structural member 21. When the solenoid 29 moves reciprocally, a link 33 is driven reciprocally to rotate latches 32, so that the second structural member 26 engages or disengages from bosses 34 disposed on the frame 10, thereby connecting or opening the second structural member 26 relative to the frame 10.

An operation of connecting and opening the first structural member 21 and the second structural member 26, and an operation of connecting and opening the second structural member 26 and the frame 10 will be described in more detail later. A control unit 101 is electrically connected through an electrical signal system for controlling the device as a whole including the operations.

Figure 2:
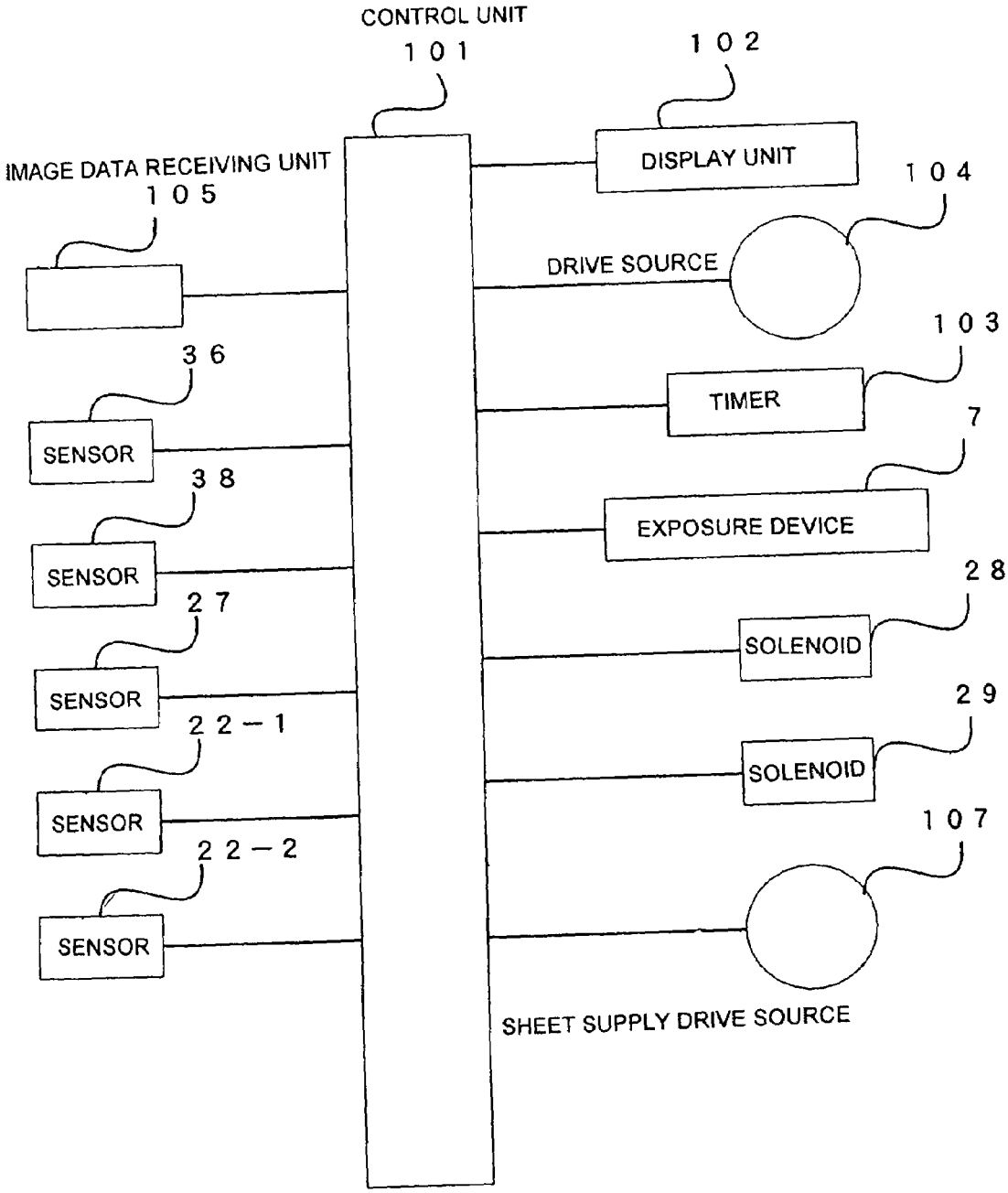
FIG. 2 is a schematic block diagram showing a control system according to the first embodiment of the present invention.

FIG. 2 is a schematic block diagram showing connection of the control unit 101 according to the first embodiment of the present invention. The control unit 101 is connected to a display unit 102; an image data receiving unit 105; a timer 103; and sensors 36, 38, 27, 22-1, and 22-2 for detecting a state of the printing sheet P during transportation. Further, the control unit 101 is connected to a drive source 104 and a sheet supply drive source 107 to be controlled.

The control unit 101 controls the sheet supply drive source 107 to rotate the sheet supply roller 4, the sheet supply auxiliary roller 3, and the separation roller 5 to transport the printing sheet P to the photo-sensitive drum one at a time in a specific interval. The control unit 101 controls the drive source 104 to transmit drive to the photo-sensitive drums 8, the developing units 9, the transfer roller 12, the belt roller 13, the fixing device 14, the discharge roller 15, the discharge rollers 19 and the sheet re-supply roller 20 to form an image on the printing sheet P while transporting the printing sheet P.

The control unit 101 is also connected to the exposure device 7 to expose the photo-sensitive drums 8, so that a static latent image is formed on the photo-sensitive drums 8 according to image data received at the image data receiving unit 105, positional information of the printing sheet P from each sensor, and timing information of the timer 103. A belt roller 13 is provided for rotating the transfer belt 11 along with a transfer roller 12. The control unit 101 is also connected to solenoids 28 and 29.

An operation of the image forming device according to the first embodiment will be explained next. First, with reference to FIG. 1, an operation of the image forming device as a whole will be explained. Then, with reference to other drawings, an operation of detecting the jam during the transportation of the printing sheet P and a process of recovering the jam will be explained in detail.

When the image forming device is not turned on, or is in an initial state, the solenoid 28 is not turned on, so that the solenoid 28 is in a stretched state due to gravity. In the stretched state of the solenoid 28, the latch 30 connected to the solenoid 28 rotates to engage the boss 31, so that the first structural member 21 and the second structural member 26 are in a locked state. When the image forming device is in the initial state, the solenoid 29 is also not turned on, so that the solenoid 29 is in a stretched state due to gravity. In the stretched state of the solenoid 29, a latch 32-1 connected to the solenoid 29 rotates to engage a boss 34-1 and a latch 32-2 rotates to engage a boss 34-2, so that the first structural member 21 and the second structural member 26 are in a locked state.

When the image forming device starts printing, the sheet supply auxiliary roller 3 picks up the printing sheet P on the cassette 1, and the sheet supply roller 4 and the separation roller 5 sandwich the printing sheet P, so that the printing sheet P is transported to the resist roller 6 in a separated state one at a time. The printing sheet P transported with the sheet supply roller 4 abuts against the resist roller 6, thereby correcting skew. The printing sheet P is transported to the transfer roller 12 at such a timing that the toner image formed on a surface of the photo-sensitive drums 8 approaches the transport path with rotation of the photo-sensitive drums 8. The toner image is transferred from the surface of the photo-sensitive drums 8 to the printing sheet P, and is fixed when the printing sheet P passes through the fixing device 14. When the image forming device is not performing the duplex printing, or an image is formed on the printing sheet P for the second time, the discharge roller 15 discharges the printing sheet P to the discharge tray 16.

When the image forming device is performing the duplex printing, the discharge roller 15 rotates forward to transport the printing sheet P until a trailing edge thereof passes through the transport path switching guide 17. At this time, in a state that the discharge roller 15 holds the printing sheet P, the discharge roller 15 reverses the rotation from the forward rotation to the reverse rotation to switch back the printing sheet P. At the same time, the transport path switching guide 17 switches the transport path, so that the printing sheet P is transported to the duplex transport path 18 through the reverse rotation of the discharge roller 15. Then, the discharge rollers 19 and the sheet re-supply roller 20 transport the printing sheet P to the resist roller 6 one more time to form an image for the second time. After the image is formed on the printing sheet P for the second time and the printing sheet P passes through the fixing device 14, the discharge roller 15 discharges the printing sheet P to the discharge tray 16, thereby completing the second image formation.

Figure 3:
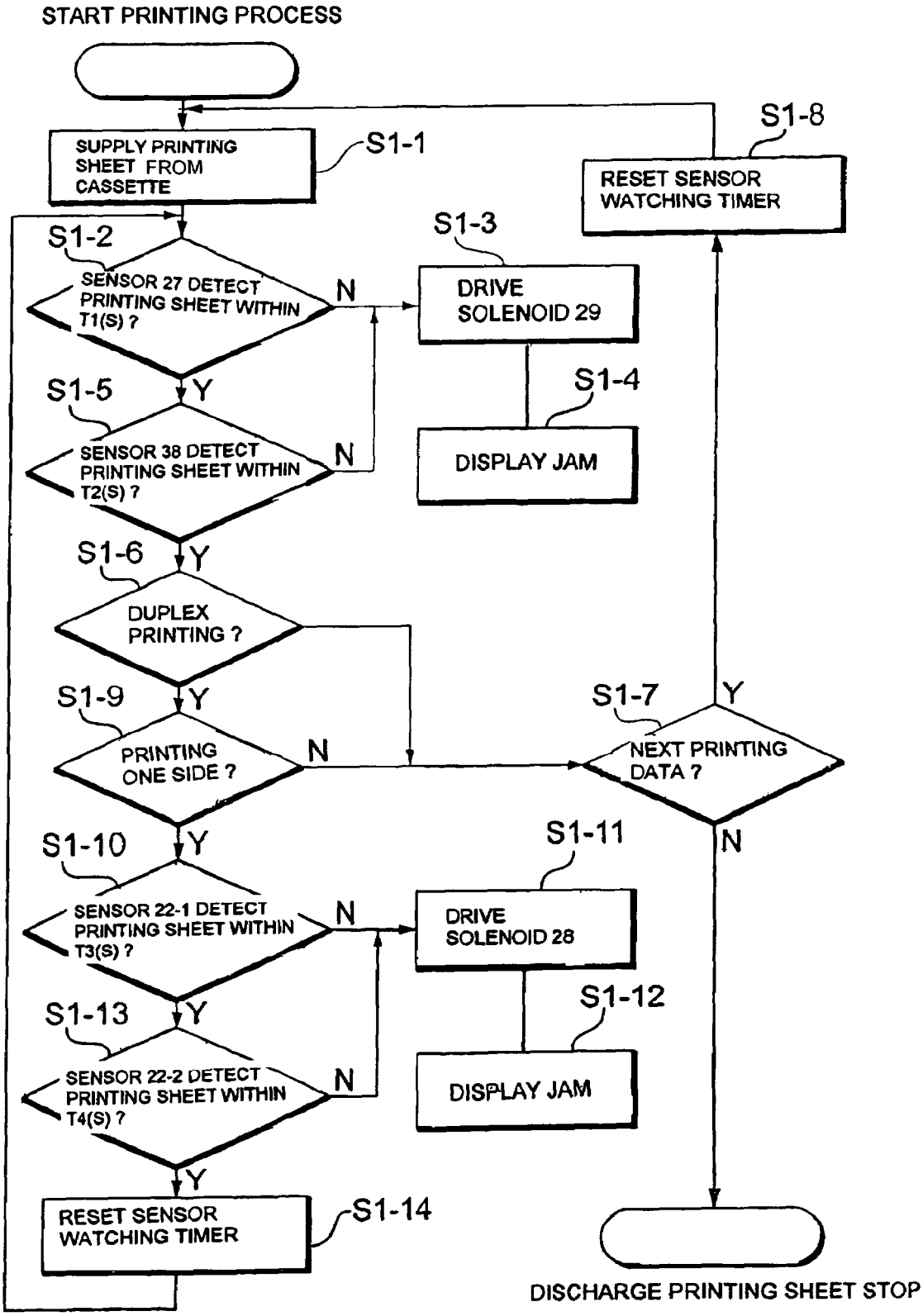
FIG. 3 is a flow chart showing a jam recovery process according to the first embodiment of the present invention.

The process of detecting the jam and the process of recovering the jam will be explained next. With reference to FIG. 3, the process of detecting the jam and the process of recovering the jam will be explained in detail from step S1-1 to step S1-14 during the transportation of the printing sheet P. Symbols in the flow chart are defined as follows. T1(s) is an estimated time from when the sheet supply roller 4 starts rotating to transport the printing sheet P to when the printing sheet P passes through the sensor 27 (FIG. 1). T2(s) is an estimated time from when the sheet supply roller 4 starts rotating to transport the printing sheet P to when the printing sheet P passes through the sensor 38 (FIG. 1). T3(s) is an estimated time from when the sheet supply roller 4 starts rotating to transport the printing sheet P to when the printing sheet P passes through the sensor 22-1 (FIG. 1). T4(s) is an estimated time from when the sheet supply roller 4 starts rotating to transport the printing sheet P to when the printing sheet P passes through the sensor 22-2 (FIG. 1). The estimated times T1(s) to T4(s) are set in the timer 103 in the control unit 101 in advance.

Step S1-1

The printing process starts, and the printing sheet P starts being transported from the cassette 1 (FIG. 1). At the same time, the timer 103 of the control unit 101 starts measuring time.

Step S1-2

When the sensor 27 (FIG. 1) does not detect the printing sheet P within T1(s) since the sheet supply roller 4 starts rotating, the process proceeds to step S1-3. When the sensor 27 detects the printing sheet P, the process proceeds to step S1-5.

Step S1-3

Figure 4:
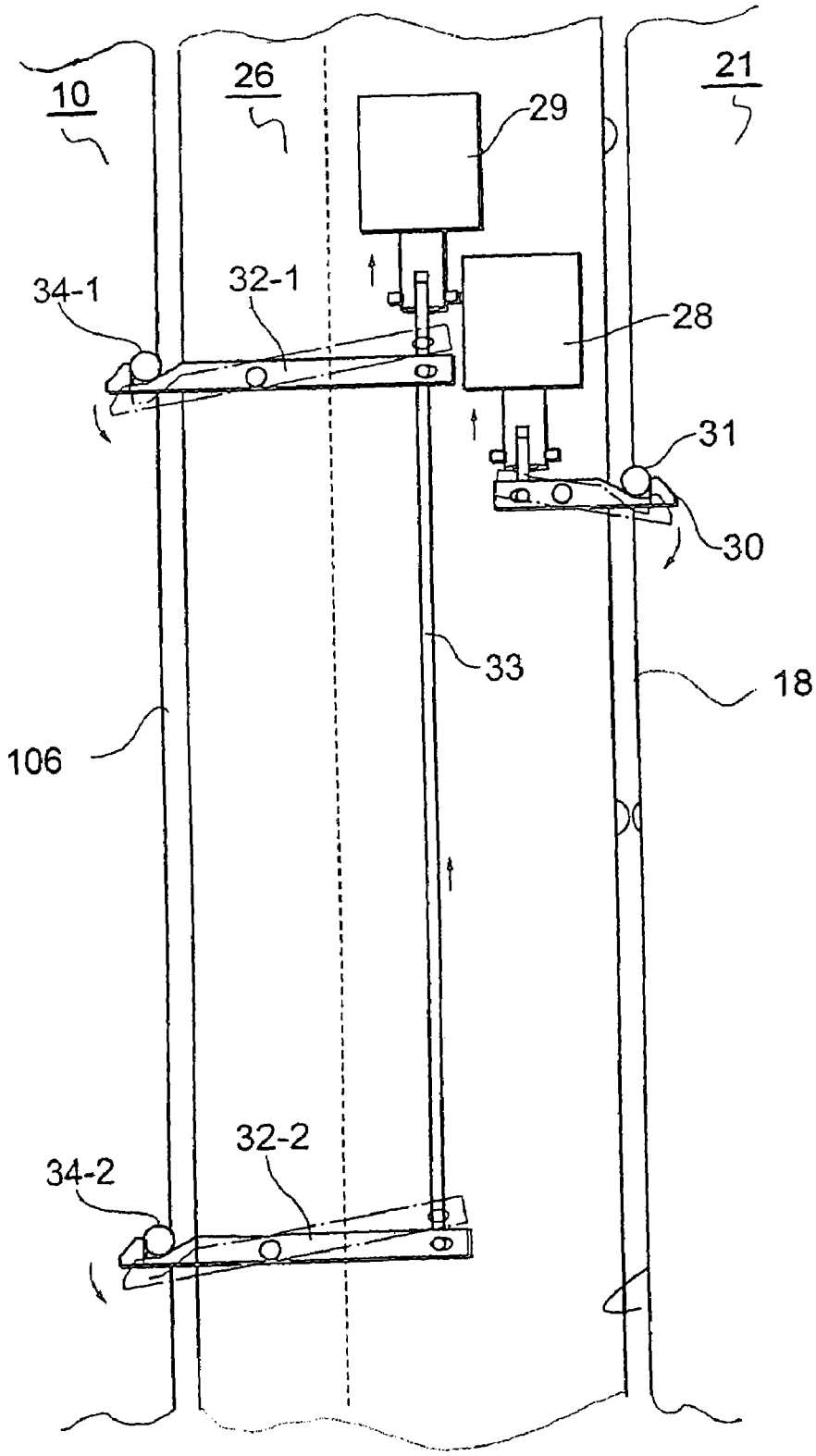
FIG. 4 is a schematic sectional view showing the image forming device according to the first embodiment of the present invention.

Since the sensor 27 (FIG. 1) does not detect the printing sheet P within T1(s) since the sheet supply roller 4 starts rotating, it is determined that the jam occurs during the transportation and the printing sheet P remains in the image forming transport path 106 between the developing units 9 (FIG. 1) and the transfer belt 11 (FIG. 1). The control unit 101 stops the drive source 104 and the sheet supply drive source 107 to stop the image formation process, and drives the solenoid 29 (FIG. 4) to rotate the latches 32-1 and 32-2 (FIG. 4) through the reciprocal movement of the link 33 (FIG. 4), thereby releasing the latches 32-1 and 32-2 from the bosses 34-1 and 34-2 (FIG. 4).

Step S1-4

Figure 5:
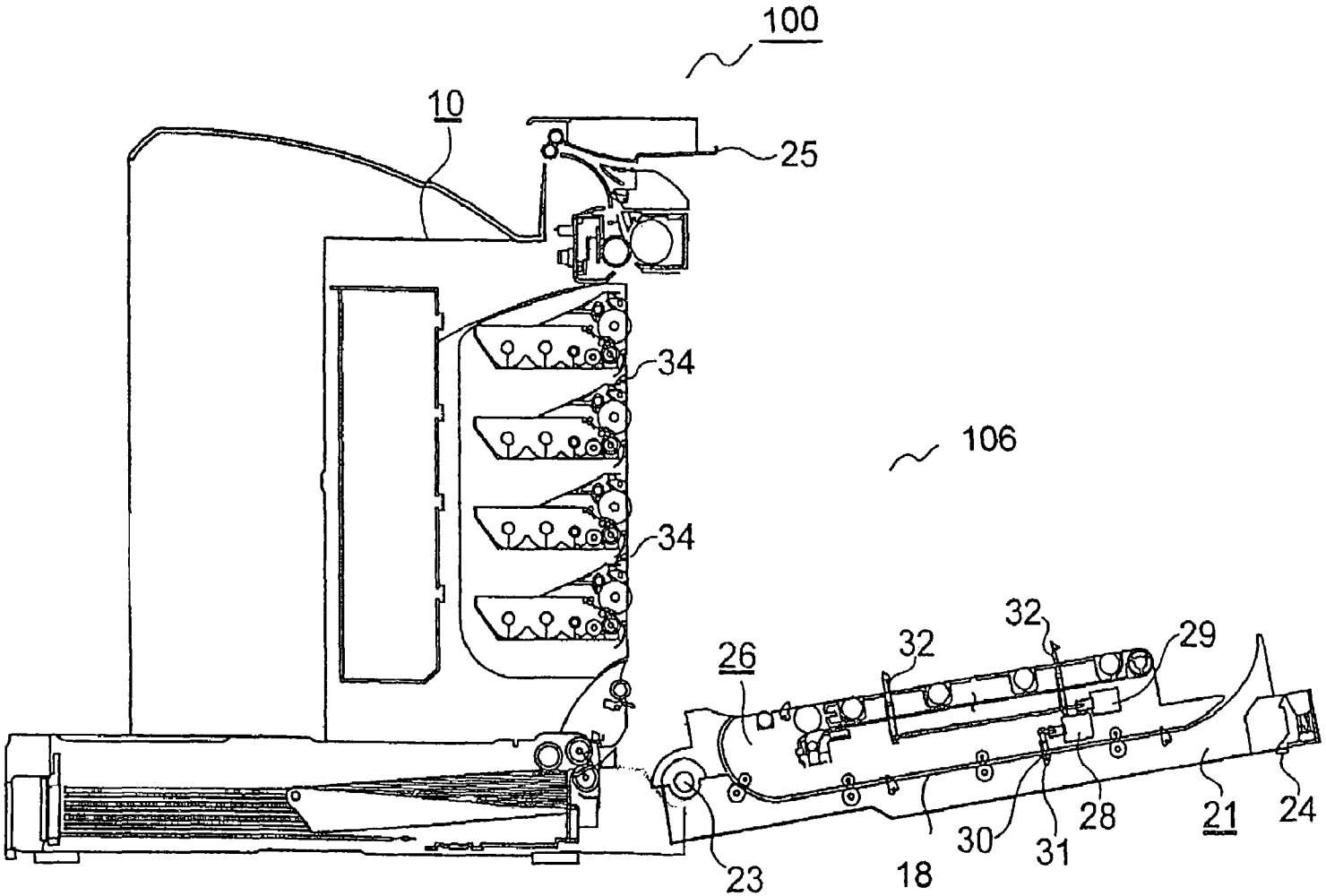
FIG. 5 is a sectional view showing an operation (No. 1) of the image forming device according to the first embodiment of the present invention.

The control unit 101 controls the display unit 102 to display the occurrence of the jam to notify an operator, thereby requesting removal of the printing sheet P remaining due to the jam. When the operator pulls up the handle 24 (FIG. 1) to remove the printing sheet P causing the jam, the handle 24 (FIG. 1) is released from the protrusion 25 (FIG. 1) disposed on the frame 10 (FIG. 1). Accordingly, as shown in FIG. 5, the first structural member 21 and the second structural member 26 rotate around the rotational pivot 23 and open. At this time, the latch 30 of the second structural member 26 engages the boss 31 of the first structural member 21, so that the first structural member 21 and the second structural member 26 are integrated. As described above, when the printing sheet P is jammed in the image forming transport path 106 between the developing units 9 (FIG. 1) and the transfer belt 11 (FIG. 1), the location of the jam where the printing sheet P remains is opened to a large extent with the single handle operation, thereby making it easy to find the jammed sheet and recover the jam.

Step S1-5

When the sensor 38 (FIG. 1) does not detect the printing sheet P within T2(s) since the sheet supply roller 4 starts rotating, it is determined that the jam occurs during the transportation between the developing units 9 (FIG. 1) and the transfer belt 11 (FIG. 1) and the printing sheet P remains in the image forming transport path 106 between the developing units 9 (FIG. 1) and the transfer belt 11 (FIG. 1). Accordingly, similar to the case when the sensor 27 (FIG. 1) does not detect the printing sheet P within T1(s), the process proceeds to steps S1-3 and S1-4 to recover the jam. When the sensor 38 (FIG. 1) detects the printing sheet P within T2(s), the process proceeds to step S1-6.

Step S1-6

When the image forming device is not performing the duplex printing (printing one side), the process proceeds to step S1-7. When the image forming device is performing the duplex printing (printing both sides), the process proceeds to step S1-9.

Step S1-7

When there is next print data, the process proceeds to step S1-8. When there is no print data, the process stops.

Step S1-8

The control unit 101 sets the timer 103 to zero, and the process returns to step S1-1 for starting the next printing process.

Step S1-9

In a case that the duplex printing needs to be performed and both sides are printed, the process proceeds to step S1-7, so that the process of printing one side in step S1-6 is performed. On the other hand, in a case that the duplex printing needs to be performed and only one side is printed, the process proceeds to step S1-10.

Step S1-10

When the sensor 22-1 (FIG. 1) does not detect the printing sheet P within T3(s) since the sheet supply roller 4 starts rotating, the process proceeds to step S1-1 . When the sensor 22-1 detects the printing sheet P, the process proceeds to step S1-13.

Step S1-11

Since the sensor 22-1 (FIG. 1) does not detect the printing sheet P within T3(s) since the sheet supply roller 4 starts rotating, it is determined that the jam occurs at an entrance of the duplex transport path 18 and the printing sheet P remains in the duplex transport path 18. The control unit 101 stops the drive source 104 and the sheet supply drive source 107 to stop the image formation process, and drives the solenoid 28 (FIG. 4) to rotate the latch 30 (FIG. 4), thereby releasing the latch 30 from the boss 31 (FIG. 4).

Step S1-12

Figure 6:
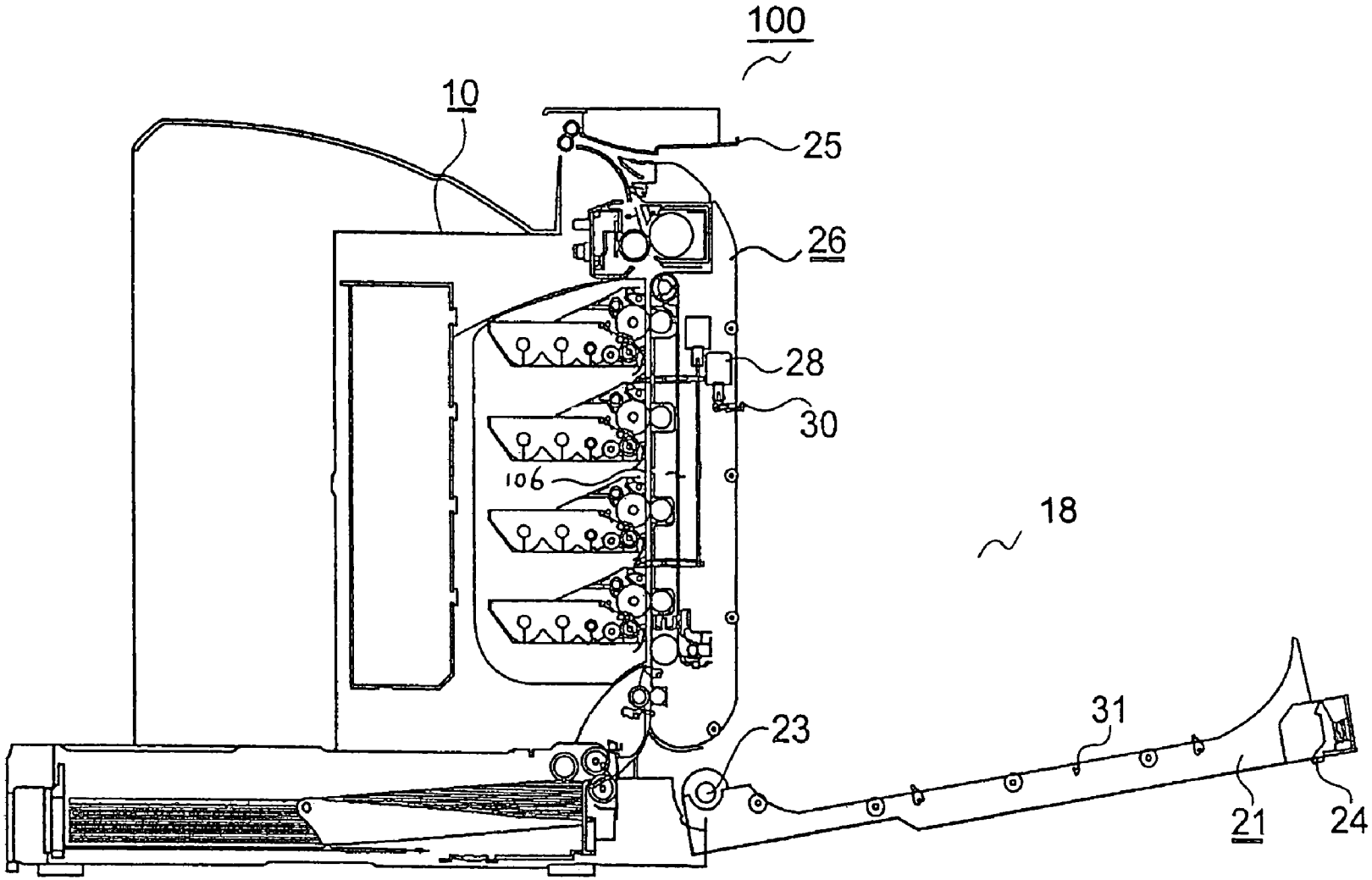
FIG. 6 is a sectional view showing an operation (No. 2) of the image forming device according to the first embodiment of the present invention.

The control unit 101 controls the display unit 102 to display the occurrence of the jam to notify the operator, thereby requesting removal of the jammed sheet. When the operator pulls up the handle 24 (FIG. 1) to remove the jammed sheet, the handle 24 (FIG. 1) is released from the protrusion 25 (FIG. 1) disposed on the frame 10 (FIG. 1). Accordingly, as shown in FIG. 6, the first structural member 21 rotates around the rotational pivot 23 and open. At this time, the latches 32-1 and 32-2 (FIG. 4) of the second structural member 26 engage the bosses 34-1 and 34-2 (FIG. 4) of the frame 10, so that the frame 10 and the second structural member 26 are integrated. As described above, when the printing sheet P is jammed in the duplex transport path 18, the location of the jam where the printing sheet P remains is opened to a large extent with the single handle operation, thereby making it easy to find the jammed sheet and recover the jam.

Step S1-13

When the sensor 22-2 (FIG. 1) does not detect the printing sheet P within T4(s) since the sheet supply roller 4 starts rotating, it is determined that the jam occurs during the transportation in the duplex transport path 18 (FIG. 1) and the printing sheet P remains in the duplex transport path 18 (FIG. 1). Accordingly, similar to the case when the sensor 22-1 (FIG. 1) does not detect the printing sheet P within T3(s), the process proceeds to steps S1-11 and S1-13 to recover the jam. When the sensor 22-2 (FIG. 1) detects the printing sheet P within T4(s), the process proceeds to step S1-14.

Step S1-14

The control unit 101 resets the timer, and the process returns to step S1-2 to print the second sheet.

When a plurality of printing sheets P is transported and jammed, it is possible that the printing sheets remain both between the developing units 9 and the transfer belt 11 and in the duplex transport path 18. In this case, once the printing sheet P is removed from the jam location, other printing sheets P are transported and discharged to the discharge tray 16, thereby making it possible to resume the printing process.

As described above, when the jam occurs during the transportation, the jam location where the printing sheet remains is detected and opened to a large extent with the single handle operation, thereby making it easy to find the jammed sheet and recover the jam.

Second Embodiment

In the first embodiment, it is possible to deal with the case that several printing sheets P are transported sequentially. However, the first embodiment does not consider the jam recovery in a case that the printing sheet remains both between the developing units 9 and the transfer belt 11, and in the duplex transport path 18. In the second embodiment, it is possible to deal with the jam recovery in a case that the printing sheet remains one of between the developing units 9 and the transfer belt 11, and in the duplex transport path 18, and a case that the printing sheet remains both between the developing units 9 and the transfer belt 11, and in the duplex transport path 18 substantially at the same time.

Figure 7:
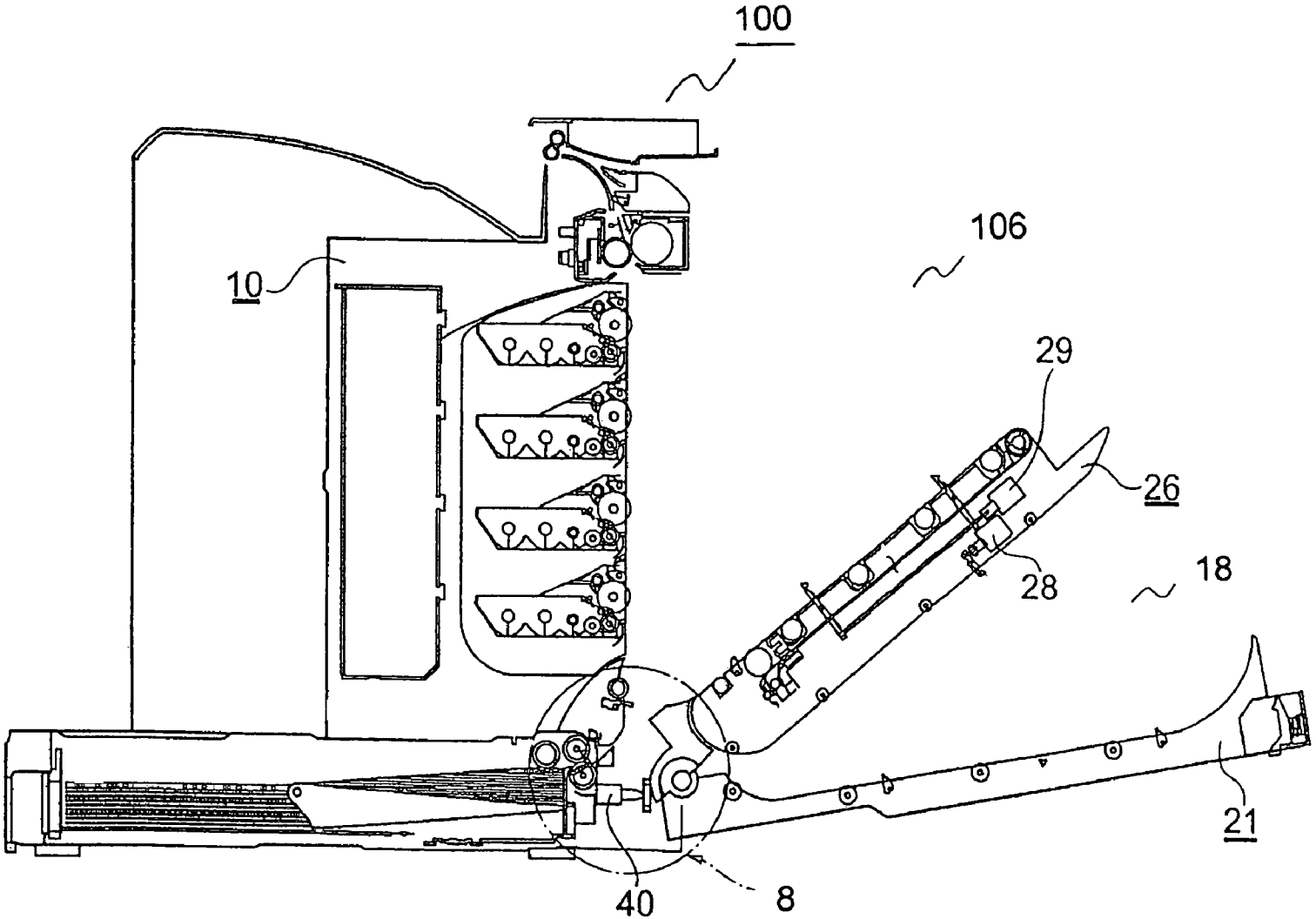
FIG. 7 is a sectional view showing an image forming device according to a second embodiment of the present invention.
Figure 8:
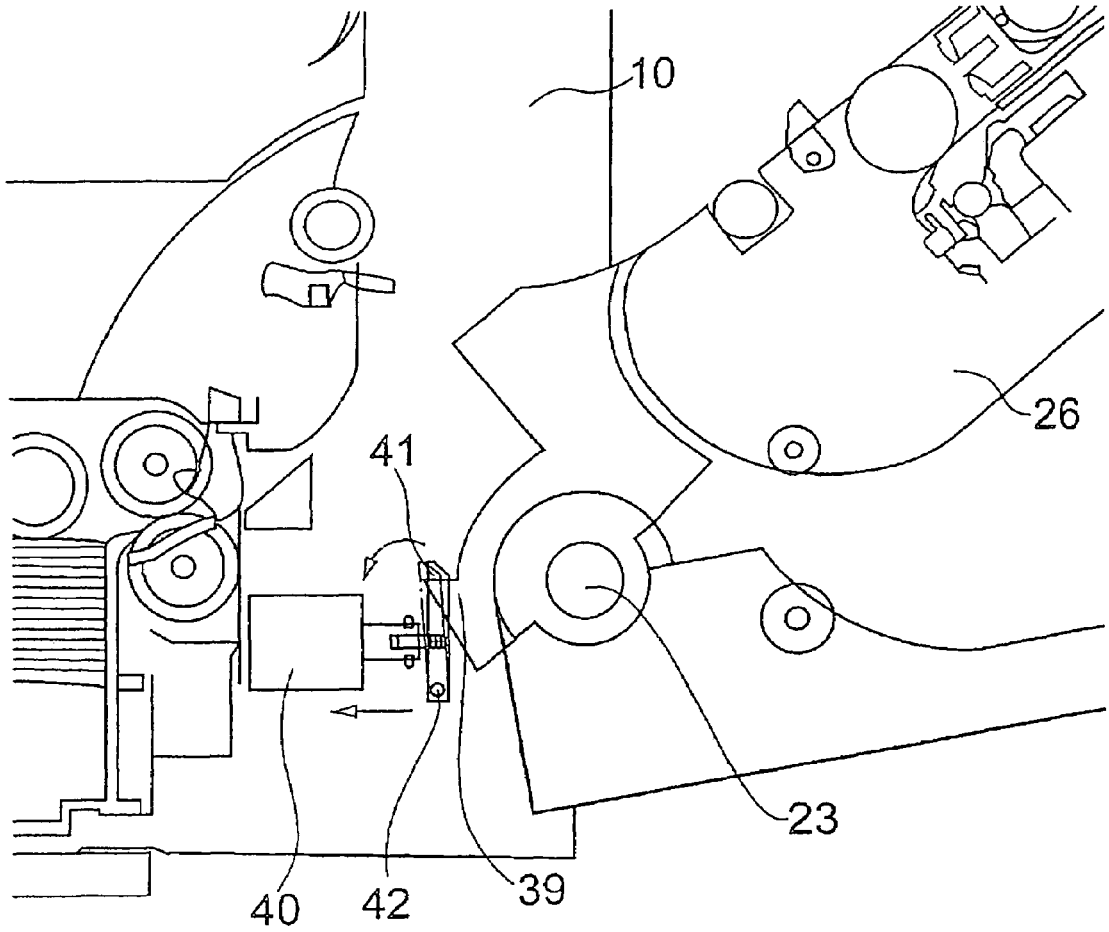
FIG. 8 is an enlarged view of a part 8 in FIG. 7.

FIG. 7 is a sectional view showing an image forming device according to the second embodiment of the present invention. FIG. 8 is an enlarged view of a part 8 in FIG. 7. Only differences from the first embodiment will be explained. Components same as those in the first embodiment are designated with the same reference numerals, and explanations thereof are omitted.

As shown in FIG. 8, a solenoid 40 fixed to the frame 10 and a latch 41 rotating around a rotational pivot 42 disposed on the frame 10 when the solenoid 40 moves reciprocally are added to the image forming device in the first embodiment. As shown in FIG. 8, the latch 41 is arranged to engage and disengage from a projection 39 disposed near the rotational pivot 23 of the second structural member 26.

Figure 9:
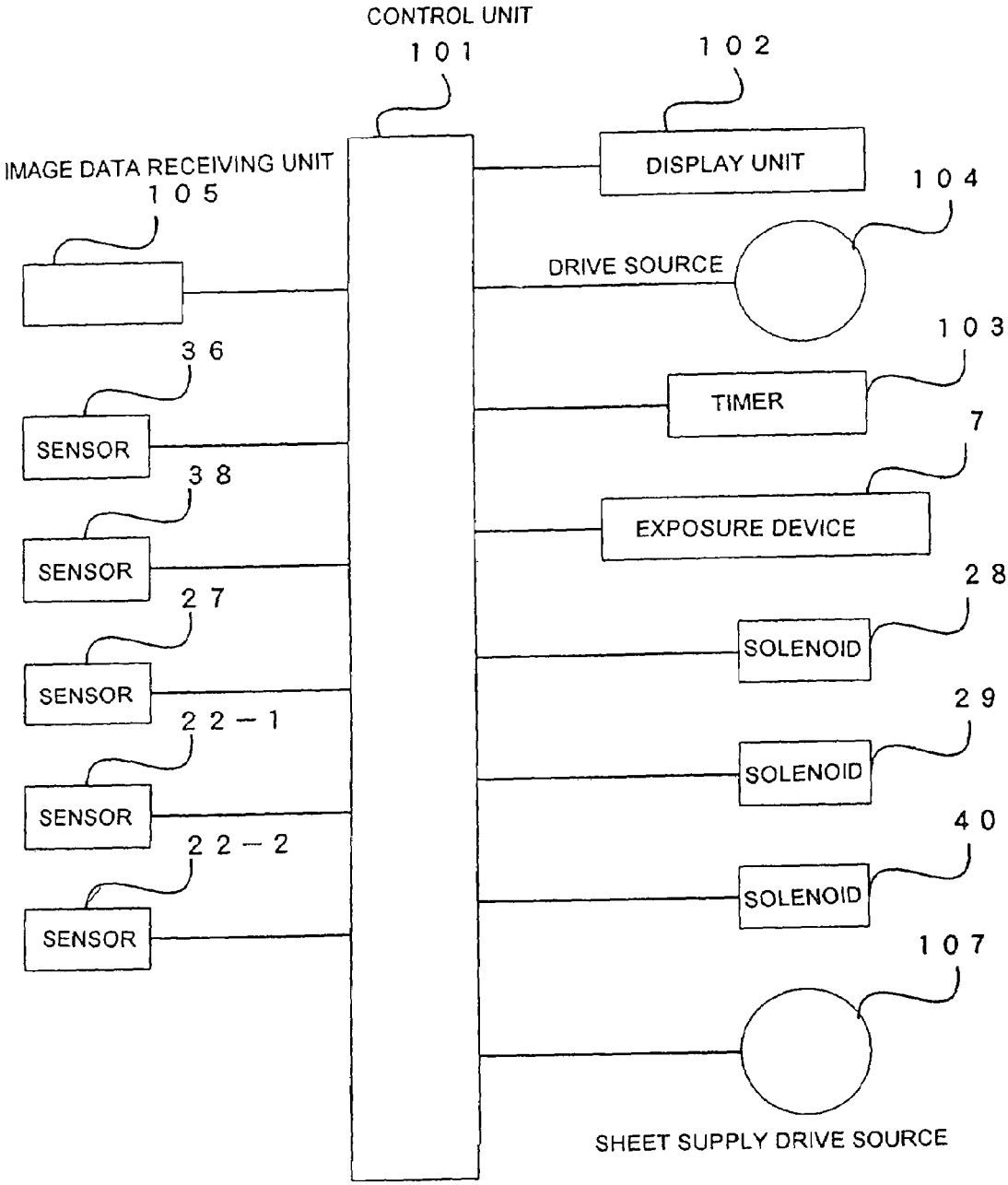
FIG. 9 is a schematic block diagram showing a control system according to the second embodiment of the present invention.

FIG. 9 is a schematic block diagram showing connection of a control system according to the second embodiment of the present invention. The control unit 101 is connected to the display unit 102 for displaying a message; the image data receiving unit 105; the timer 103; and sensors 36, 38, 27, 22-1, and 22-2 for detecting transportation state of the printing sheet P. Further, the control unit 101 is connected to the drive source 104 and the sheet supply drive source 107 to be controlled.

The control unit 101 controls the sheet supply drive source 107 to rotate the sheet supply roller 4, the sheet supply auxiliary roller 3, and the separation roller 5 to transport the printing sheet P to the photo-sensitive drum one at a time in a specific interval. The control unit 101 controls the drive source 104 to transmit drive to the photo-sensitive drums 8, the developing units 9, the transfer roller 12, the belt roller 13, the fixing device 14, the discharge roller 15, the discharge rollers 19 and the sheet re-supply roller 20 to form an image on the printing sheet P while transporting the printing sheet P.

The control unit 101 is also connected to the exposure device 7 to expose the photo-sensitive drums 8, so that a static latent image is formed on the photo-sensitive drums 8 according to image data received at the image data receiving unit 105, positional information of the printing sheet P from each sensor, and timing information of the timer 103. The belt roller 13 is provided for rotating the transfer belt 11 along with the transfer roller 12. The control unit 101 is also connected to the solenoids 28, 29 and 40.

An operation of the image forming device according to the second embodiment will be explained next. An operation of the image forming device as a whole is the same as that in the first embodiment, and explanation thereof is omitted. An operation of detecting the jam during transportation of the printing sheet P and a process of recovering the jam will be explained in detail.

Figure 10:
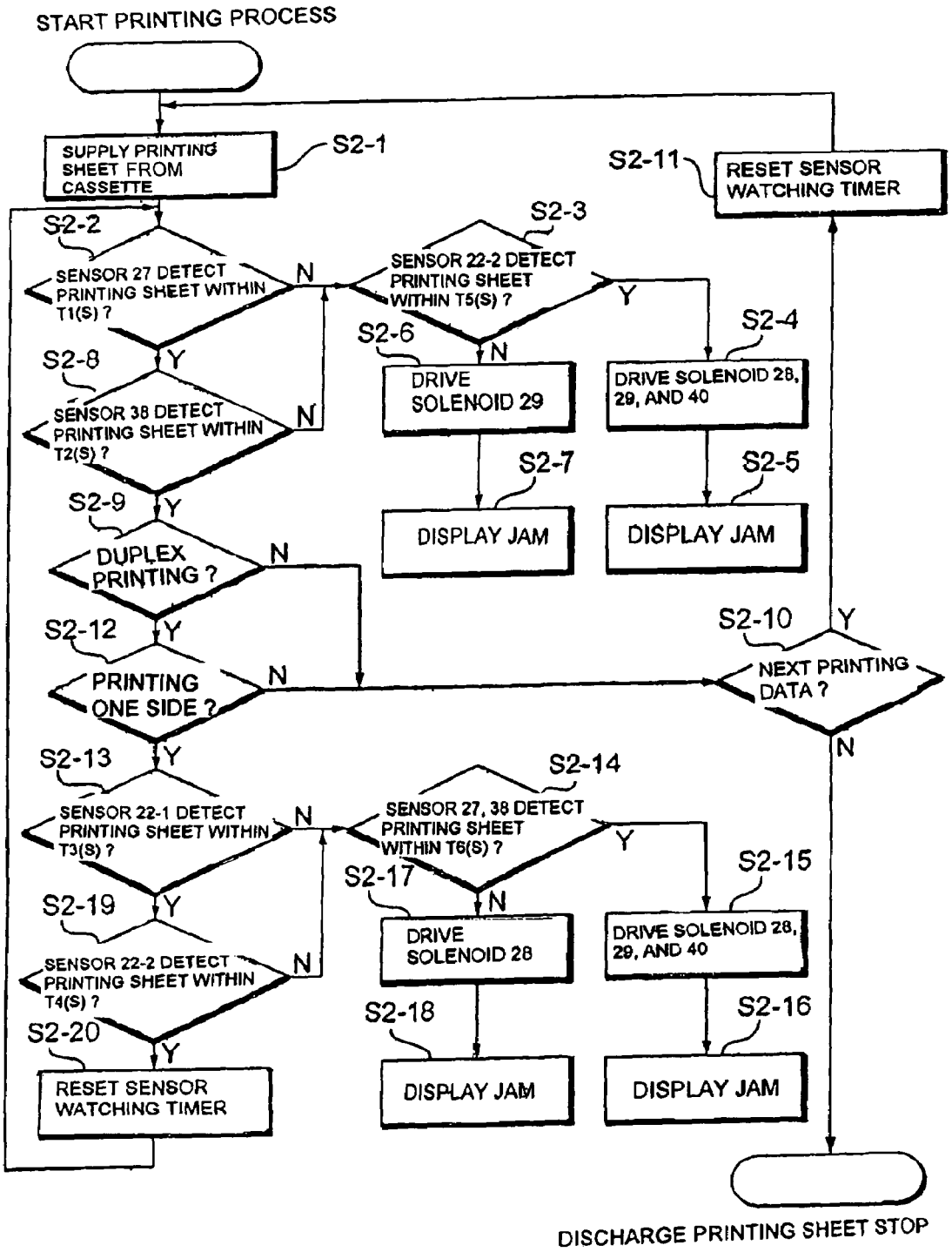
FIG. 10 is a flow chart showing a jam recovery process according to the second embodiment of the present invention.

FIG. 10 is a flow chart showing a jam recovery process according to the second embodiment of the present invention. With reference to FIG. 10, the process of detecting the jam and the process of recovering the jam will be explained in detail from step S2-1 to step S2-20 during the transportation of the printing sheet P. Symbols in the flow chart are defined as follows. T1(s) is an estimated time from when the sheet supply roller 4 starts rotating to transport the printing sheet P to when the printing sheet P passes through the sensor 27 (FIG. 1). T2(s) is an estimated time from when the sheet supply roller 4 starts rotating to transport the printing sheet P to when the printing sheet P passes through the sensor 38 (FIG. 1). T3(s) is an estimated time from when the sheet supply roller 4 starts rotating to transport the printing sheet P to when the printing sheet P passes through the sensor 22-1 (FIG. 1). T4(s) is an estimated time from when the sheet supply roller 4 starts rotating to transport the printing sheet P to when the printing sheet P passes through the sensor 22-2 (FIG. 1). T5(s) is a specific time since when the printing sheet P passes through the sensor 22-1 (FIG. 1) or the sensor 22-2 (FIG. 1). T6(s) is a specific time since when the printing sheet P passes through the sensor 27 (FIG. 1) or the sensor 38 (FIG. 1). The estimated times T1(s) to T6(s) are set in the timer 103 in the control unit 101 in advance.

Step S2-1

The supply roller 4 starts rotating to transport the printing sheet P0, and then the printing sheet P1 from the cassette 1 (FIG. 1). At the same time, the timer 103 of the control unit 101 starts measuring time.

Step S2-2

When the sensor 27 (FIG. 1) does not detect the printing sheet P within T1(s) since the sheet supply roller 4 starts rotating, the process proceeds to step S2-3. When the sensor 27 detects the printing sheet P1, the process proceeds to step S2-8.

Step S2-3

When the sensor 22-1 or the sensor 22-2 detects the printing sheet P0 and it is within T5(s), the process proceeds to step S2-4, otherwise proceeds to step S2-6.

Step S2-4

Since the sensor 27 (FIG. 1) does not detect the printing sheet P within T1(s) since the sheet supply roller 4 starts rotating, it is determined that the jam occurs during the transportation and the printing sheet P1 remains in the image forming transport path 106 between the developing units 9 (FIG. 1) and the transfer belt 11 (FIG. 1). The control unit 101 stops the drive source 104 and the sheet supply drive source 107 to stop the image formation process, and drives the solenoid 28 and the solenoid 29 (FIG. 4) to separate the first structural member 21, the second structural member 26, and the frame 10. Further, the control unit 101 drives the solenoid 40, so that the projection of the second structural member 26 can engage the latch 41.

Step S2-5

The control unit 101 controls the display unit 102 to display the occurrence of the jam to notify an operator, thereby requesting removal of the jammed sheet. When the operator pulls up the handle 24 (FIG. 1) to remove the jammed sheet, the handle 24 (FIG. 1) is released from the protrusion 25 (FIG. 1) disposed on the frame 10 (FIG. 1). Accordingly, as shown in FIG. 5, the first structural member 21 and the second structural member 26 rotate around the rotational pivot 23 and open. At this time, when the second structural member 26 rotates by a specific angle, the projection 39 of the second structural member 26 engages the latch 41 (FIG. 8), and the second structural member 26 stops. The first structural member 21 rotates by the specific angle and stops similar to the first embodiment. As a result, as shown in FIG. 7, the frame 10, the first structural member 21, and the second structural member 26 are opened in the separated state, respectively. As described above, when the printing sheet P is jammed both between the developing units 9 (FIG. 1) and the transfer belt 11 (FIG. 1) and in the duplex transport path 18 (FIG. 1), the locations of the jams where the printing sheets P0 and P1 remain are opened to a large extent with the single handle operation, thereby making it easy to find the jammed sheet and recover the jam.

Step S2-6

Since the sensor 27 (FIG. 1) does not detect the printing sheet P1 within T1(s), it is determined that the jam occurs during the transportation and the printing sheet P1 remains in the image forming transport path 106 between the developing units 9 (FIG. 1) and the transfer belt 11 (FIG. 1). Also, it has passed T5(s) since the sensor 22-1 or 22-2 detects the printing sheet P0, so that it is determined that the printing sheet P0 does not remain in the duplex transport path 18 (FIG. 1). The control unit 101 stops the drive source 104 and the sheet supply drive source 107 to stop the image formation process, and drives the solenoid 29 (FIG. 4) to rotate the latches 32-1 and 32-2 (FIG. 4) through the reciprocal movement of the link 33 (FIG. 4), thereby releasing the engagement with the latches 32-1 and 32-2 (FIG. 4).

Step S2-7

The control unit 101 controls the display unit 102 to display the occurrence of the jam to notify and requests the operator to remove the jammed sheet P1. When the operator pulls up the handle 24 (FIG. 1) to remove the jammed sheet, the handle 24 (FIG. 1) is released from the protrusion 25 (FIG. 1) disposed on the frame 10 (FIG. 1). Accordingly, similar to the first embodiment shown in FIG. 5, the first structural member 21 and the second structural member 26 rotate around the rotational pivot 23 and open. Accordingly, when the jam occurs only between the developing units 9 (FIG. 1) and the transfer belt 11 (FIG. 1), the location of the jam where the printing sheet P1 remains is opened to a large extent with the single handle operation, thereby making it easy to find the jammed sheet and recover the jam.

Step S2-8

When the sensor 38 (FIG. 1) does not detect the printing sheet P1 within T2(s), it is determined that the jam occurs during the transportation between the developing units 9 (FIG. 1) and the transfer belt 11 (FIG. 1) and the printing sheet P1 remains in the image forming transport path 106 between the developing units 9 (FIG. 1) and the transfer belt 11 (FIG. 1). Accordingly, similar to step S2-2 when the sensor 27 (FIG. 1) does not detect the printing sheet P1 within T1(s), the process proceeds to steps S2-4 or S2-6 through step 2-3 to recover the jam. When the sensor 38 (FIG. 1) detects the printing sheet P1 within T2(s), the process proceeds to step S2-9.

Step S2-9

When the image forming device is not performing the duplex printing (printing one side), the process proceeds to step S2-1 . When the image forming device is performing the duplex printing (printing both sides), the process proceeds to step S2-12.

Step S2-10

When there is next print data, the process proceeds to step S2-11. When there is no print data, the process stops.

Step S2-11

The control unit 101 resets the timer 103, and the process returns to step S2-1 for starting the next printing process.

Step S2-12

In a case that the duplex printing needs to be performed and both sides are printed, the process proceeds to step S2-10, so that the process of printing one side in step S2-9 is performed. On the other hand, in a case that the duplex printing needs to be performed and only one side is printed, the process proceeds to step S2-13.

Step S2-13

When the sensor 22-1 (FIG. 1) does not detect the printing sheet P within T3(s) since the sheet supply roller 4 starts rotating, the process proceeds to step S2-14. When the sensor 22-1 detects the printing sheet P, the process proceeds to step S2-19.

Step S2-14

When it is within T6(s) since the sensor 27 or the senor 38 detects the printing sheet P2, the process proceeds to step S2-15, otherwise proceeds to step S2-17.

Step S2-15

Since the sensor 22-1 (FIG. 1) does not detect the printing sheet P1 within T3(s) since the sheet supply roller 4 starts rotating, it is determined that the jam occurs in the duplex transport path 18 (FIG. 1) and the printing sheet P1 remains in the duplex transport path 18 (FIG. 1). Further, since it is within T6(s) since the sensor 27 or the sensor 38 detects the printing sheet P2, it is determined that the printing sheet P2 still remains in the image forming transport path 106 between the developing units 9 (FIG. 1) and the transfer belt 11 (FIG. 1). The control unit 101 stops the drive source 104 and the sheet supply drive source 107 to stop the image formation process, and drives the solenoid 28 and the solenoid 29 to separate the first structural member 21, the second structural member 26, and the frame 10, respectively. The control unit 101 also drives the solenoid 40, so that the projection 39 of the second structural member 26 can engage the latch 41.

Step S2-16

The control unit 101 controls the display unit 102 to display the occurrence of the jam to notify and requests the operator to remove the jammed sheet (printing sheet P). When the operator pulls up the handle 24 (FIG. 1) to remove the jammed sheet, the handle 24 (FIG. 1) is released from the protrusion 25 (FIG. 1) disposed on the frame 10 (FIG. 1). Accordingly, similar to the first embodiment shown in FIG. 5, the first structural member 21 and the second structural member 26 rotate around the rotational pivot 23 and open. At this time, when the second structural member 26 rotates by a specific angle, the projection 39 of the second structural member 26 engages the latch 41, and the second structural member 26 stops at the specific angle. The first structural member 21 rotates by the specific angle and stops similar to the first embodiment. As a result, as shown in FIG. 7, the frame 10, the first structural member 21, and the second structural member 26 are opened in the separated state, respectively. As described above, when the jams occur both between the developing units 9 (FIG. 1) and the transfer belt 11 (FIG. 1) and in the duplex transport path 18 (FIG. 1), the locations of the jams where the printing sheets P1 and P2 remain are opened to a large extent with the single handle operation, thereby making it easy to find the jammed sheet and recover the jam.

Step S2-17

Since the sensor 22-1 (FIG. 1) does not detect the printing sheet P within T3(s) since the sheet supply roller 4 starts rotating, it is determined that the jam occurs at an entrance of the duplex transport path 18 and the printing sheet P1 remains in the duplex transport path 18. Further, with the sensor 27 or the sensor 38, it is determined that the printing sheet P2 does not remain in the image forming transport path 106 between the developing units 9 (FIG. 1) and the transfer belt 11 (FIG. 1). The control unit 101 stops the drive source 104 and the sheet supply drive source 107 to stop the image formation process, and drives the solenoid 28 (FIG. 4) to rotate the latch 30 (FIG. 4), thereby releasing the latch 30 from the boss 31 (FIG. 4).

Step S2-18

The control unit 101 controls the display unit 102 to display the occurrence of the jam to notify the operator, thereby requesting removal of the jammed sheet. When the operator pulls up the handle 24 (FIG. 1) to remove the jammed sheet, the handle 24 (FIG. 1) is released from the protrusion 25 (FIG. 1) disposed on the frame 10 (FIG. 1). Accordingly, as shown in FIG. 6, the first structural member 21 rotates around the rotational pivot 23 and open. At this time, the latches 32-1 and 32-2 (FIG. 4) of the second structural member 26 engage the bosses 34-1 and 34-2 (FIG. 4) of the frame 10, so that the frame 10 and the second structural member 26 are integrated. As described above, when the jam occurs in the duplex transport path 18, the location of the jam where the printing sheet P remains is opened to a large extent with the single handle operation, thereby making it easy to find the jammed sheet and recover the jam.

Step S2-19

When the sensor 22-2 (FIG. 1) does not detect the printing sheet P1 within T4(s) since the sheet supply roller 4 starts rotating, it is determined that the jam occurs in the duplex transport path 18 (FIG. 1) during the transportation and the printing sheet P1 remains in the duplex transport path 18 (FIG. 1). Accordingly, similar to step S2-13 in which the sensor 22-1 (FIG. 1) does not detect the printing sheet P1 within T3(s) since the sheet supply roller 4 starts rotating, the process proceeds to step S2-15 or step S2-17 through step S2-14 for similar jam recovery. When the sensor 22-2 (FIG. 1) detects the printing sheet P within T4(s), the process proceeds to step S2-20.

Step S2-20

The control unit 101 resets the timer to zero, and the process returns to step S2-2 to print the second sheet.

As described above, the jam location where the printing sheet remains is detected and the structural members are connected or opened. Accordingly, when the jams occur at several locations, or the jam occurs at one location and the printing sheet at other location needs to be removed, it is easy to find the jammed sheet and recover the jam.

Third Embodiment

In the first embodiment, as shown in FIG. 3, the second structural member 26 is provided with the solenoids 28 and 29. Accordingly, it is possible to connect the first structural member 21 and the second structural member 26 to the frame 10 and open in the state that the first structural member 21 and the second structural member 26 are integrated, or to connect the second structural member 26 to the first structural member 21 and open in the state that the second structural member 26 and the frame 10 are integrated. In the second embodiment, as shown in FIG. 8, in addition to the configuration in the first embodiment, the frame 10 is provided with the solenoid 40. Accordingly, it is possible to open between the first structural member 21 and the second structural member 26, and between the second structural member 26 and the frame 10 at the same time. In the third embodiment, instead of the solenoids 28, 29, and 40, electromagnetic clutches are disposed between the first structural member 21 and the second structural member 26, and between the second structural member 26 and the frame 10, respectively, to constitute controllable links, thereby obtaining effects of the first and second embodiments.

Figure 11:
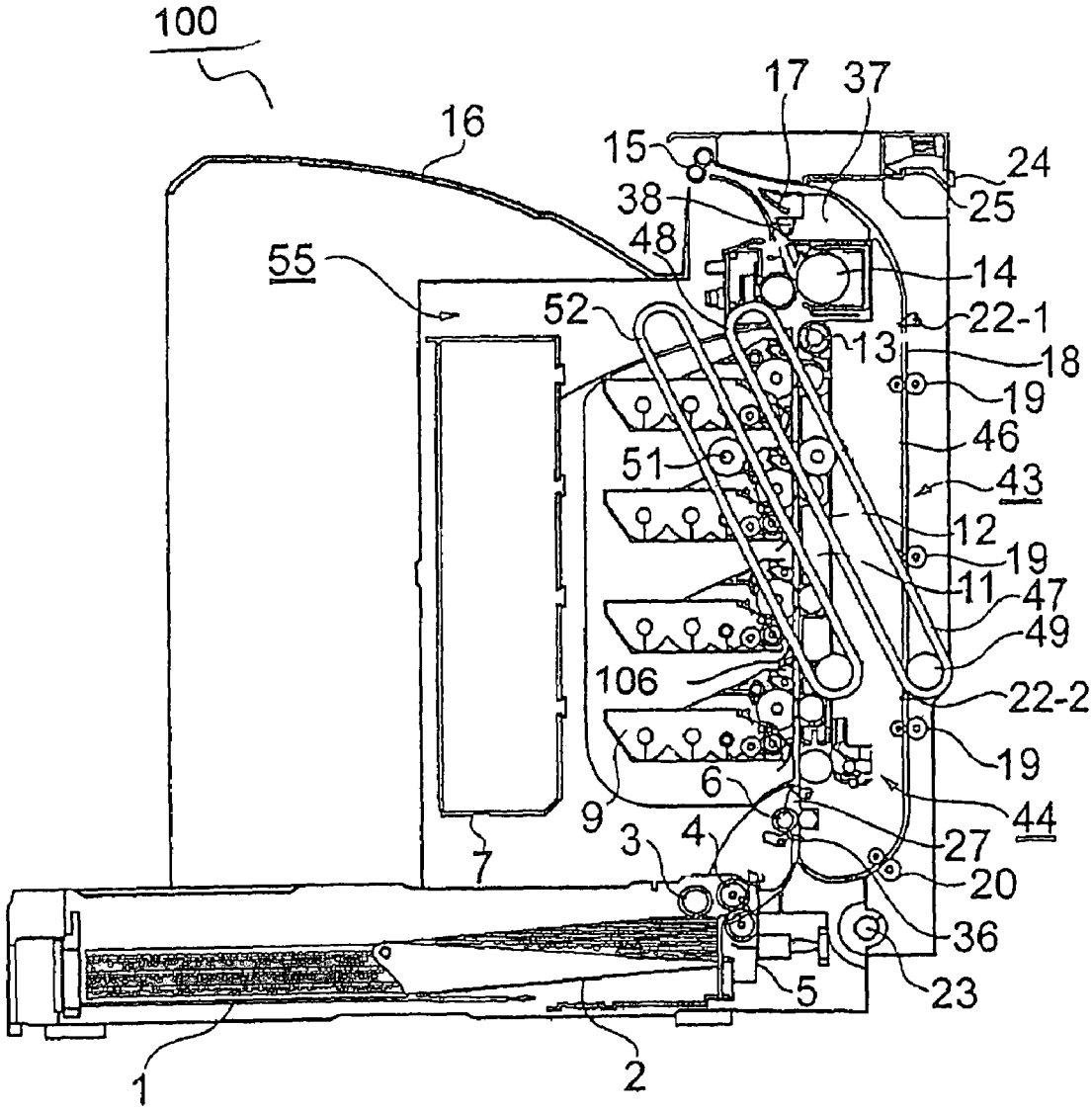
FIG. 11 is a sectional view showing an image forming device according to a third embodiment of the present invention.
Figure 12:
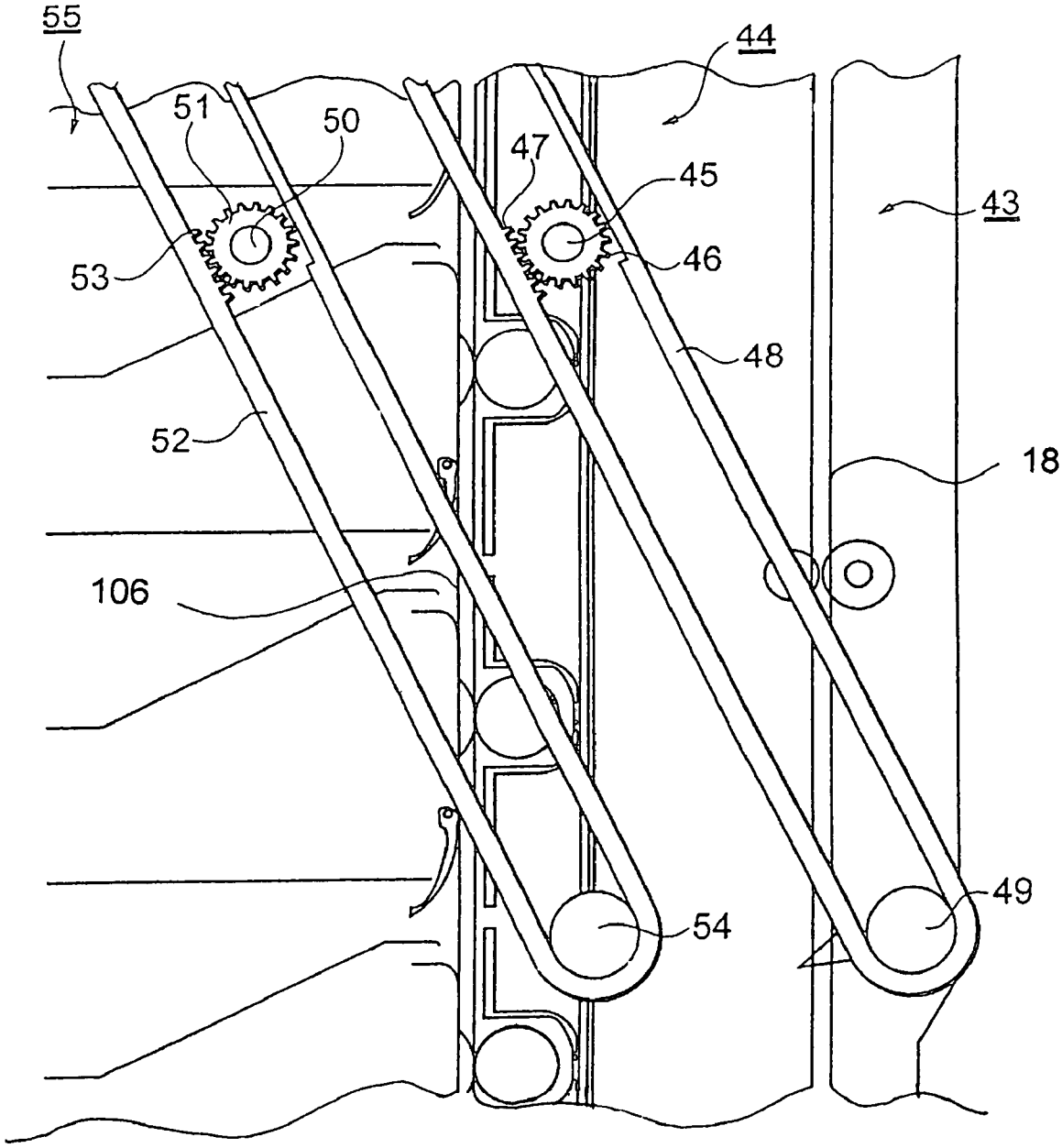
FIG. 12 is a view showing an essential part of the image forming device according to the third embodiment of the present invention.
Figure 13:
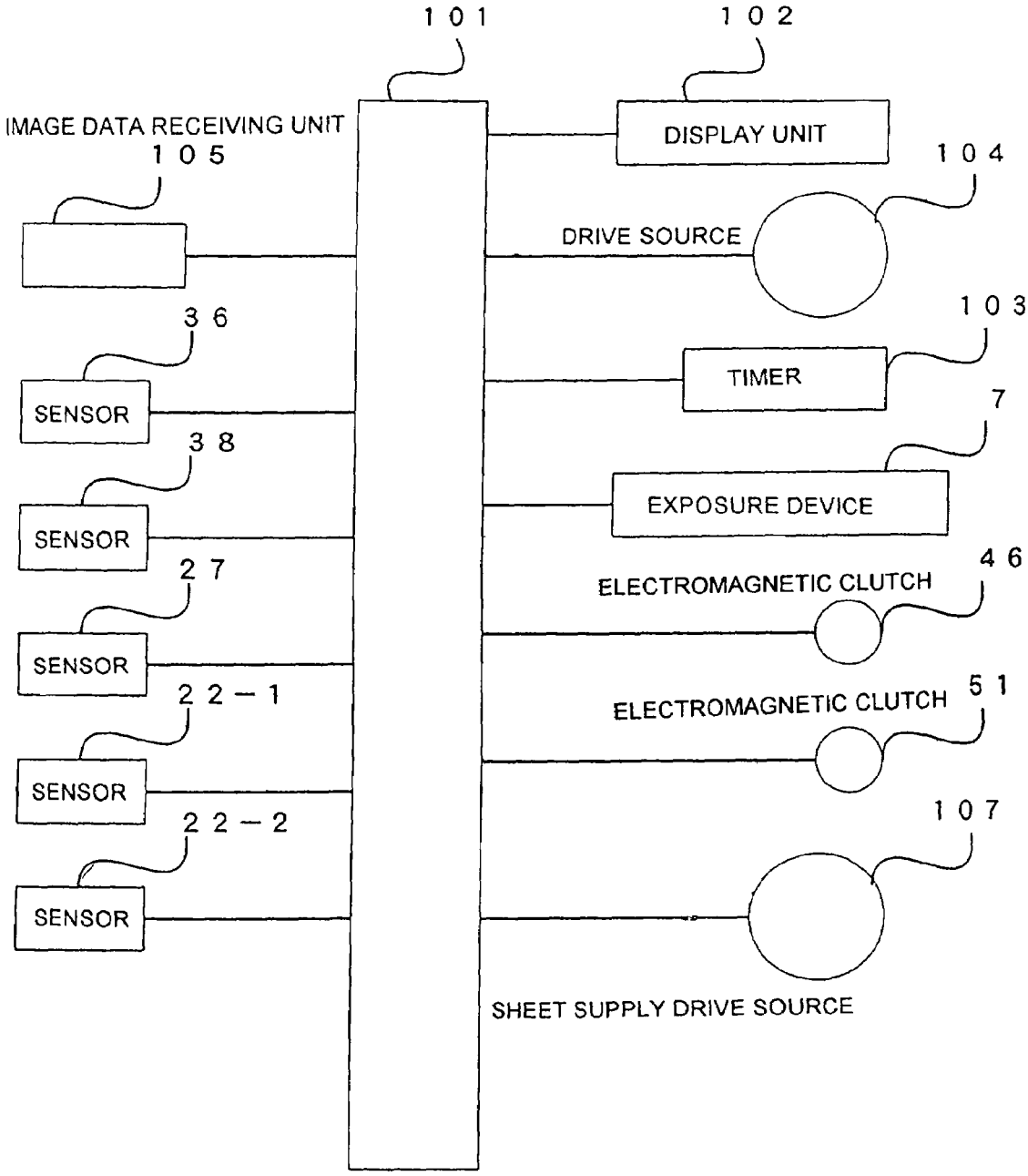
FIG. 13 is a schematic block diagram showing a control system according to the third embodiment of the present invention.

FIG. 11 is a sectional view showing an image forming device according to the third embodiment of the present invention. FIG. 12 is an enlarged view showing an essential part of the image forming device according to the third embodiment of the present invention. Only differences from the first embodiment will be explained. Components same as those in the first embodiment are designated with the same reference numerals, and explanations thereof are omitted.

As shown in FIG. 11, an image forming device 101 is provided with a frame 55 for mounting each component. The frame 55 is provided with a first structural member 43. The first structural member 43 is supported on the frame 55 with the rotational pivot 23. The handle 24 disposed at an upper portion of the first structural member 43 engages the protrusion 25 disposed on the frame 55 to fix the first structural member 43. The frame 55 is also provided with a second structural member 44. The second structural member 44 is supported on the frame 55 with the rotational pivot 23, and fixed between the first structural member 43 and the developing units 9.

As shown in FIG. 12, the second structural member 44 is provided with an electromagnetic clutch 46. The electromagnetic clutch 46 is attached to a shaft 45 fixed to the second structural member 44, and the shaft 45 has a gear portion rotatable around the shaft 45 in a non-energized state. The electromagnetic clutch 46 has a gear and engages a link 48. The link 48 has a lack gear 47 to sandwich the electromagnetic clutch 46 and engage the gear of the electromagnetic clutch 46. The link 48 is rotatably attached to a boss 49 having one end portion disposed on the first structural member 43. The frame 55 has a shaft 50 fixed to the frame 55 and an electromagnetic clutch 51 having a gear portion rotatable around the shaft 50 in a non-energized state. The electromagnetic clutch 51 has a gear and engages a link 52. The link 52 has a lack gear 53 to sandwich the electromagnetic clutch 51 and engage the gear of the electromagnetic clutch 51. The link 52 is rotatably attached to a boss 54 having one end portion disposed on the second structural member 44.

An operation of the image forming device according to the third embodiment will be explained next. An operation of the image forming device as a whole is the same as that in the first embodiment, and explanation thereof is omitted. An operation of detecting the jam during transportation of the printing sheet P and a process of recovering the jam will be explained in detail.

Figure 14:
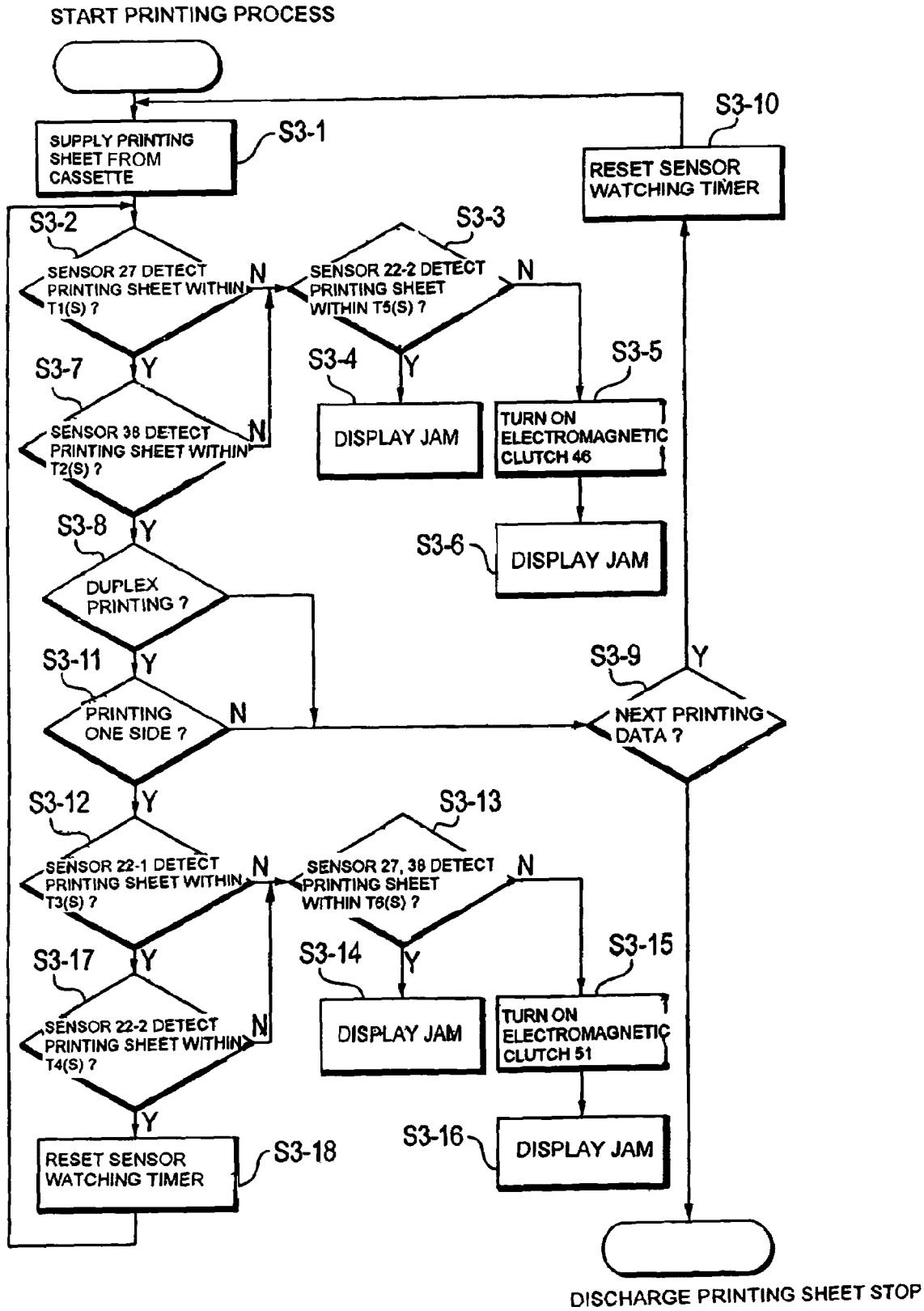
FIG. 14 is a flow chart showing a jam recovery process according to the third embodiment of the present invention.

With reference to FIG. 14, the process of detecting the jam and the process of recovering the jam will be explained in detail from step S3-1 to step S3-18 during the transportation of the printing sheet P. Symbols in the flow chart are defined as follows. T1(s) is an estimated time from when the sheet supply roller 4 starts rotating to transport the printing sheet P to when the printing sheet P passes through the sensor 27 (FIG. 11). T2(s) is an estimated time from when the sheet supply roller 4 starts rotating to transport the printing sheet P to when the printing sheet P passes through the sensor 38 (FIG. 11). T3(s) is an estimated time from when the sheet supply roller 4 starts rotating to transport the printing sheet P to when the printing sheet P passes through the sensor 22-1 (FIG. 11). T4(s) is an estimated time from when the sheet supply roller 4 starts rotating to transport the printing sheet P to when the printing sheet P passes through the sensor 22-2 (FIG. 11). T5(s) is a specific time since when the printing sheet P passes through the sensor 22-2 (FIG. 11) or the sensor 22-2 (FIG. 11). T6(s) is a specific time since when the printing sheet P passes through the sensor 27 (FIG. 11) or the sensor 38 (FIG. 11). The estimated times T1(s) to T6(s) are set in the timer 103 in the control unit 101 in advance.

Step S3-1

The printing sheet P0 and then the printing sheet P1 start being transported from the cassette 1 (FIG. 11). At the same time, the timer 103 starts measuring time.

Step S3-2

When the sensor 27 (FIG. 11) does not detect the printing sheet P within T1(s) since the sheet supply roller 4 starts rotating, the process proceeds to step S3-3. When the sensor 27 detects the printing sheet P1, the process proceeds to step S3-7.

Step S3-3

When the sensor 22-1 or the sensor 22-2 detects the printing sheet P0 and it is within T5(s), the process proceeds to step S3-4, otherwise proceeds to step S3-5.

Step S3-4

Since the sensor 27 (FIG. 11) does not detect the printing sheet P within T1(s) since the sheet supply roller 4 starts rotating, it is determined that the jam occurs during the transportation and the printing sheet P1 remains in the image forming transport path 106 between the developing units 9 (FIG. 11) and the transfer belt 11 (FIG. 11). Further, if it is within T5(s) since the sensor 22-1 or the sensor 22-2 detects the printing sheet P0, it is determined that the printing sheet P0 remains in the duplex transport path 18 (FIG. 11) regardless of the occurrence of the jam. The control unit 101 stops the drive source 104 and the sheet supply drive source 107 to stop the image formation process, and controls the electromagnetic clutch 46 and the electromagnetic clutch 51 to be in the non-energized state.

The control unit 101 controls the display unit 102 to display the occurrence of the jam to notify an operator, thereby requesting removal of the jammed sheet. In this state, the first structural member 43, the second structural member 44, and the frame 55 are separated. When the operator pulls up the handle 24 (FIG. 11) to remove the jammed sheet, the handle 24 (FIG. 11) is released from the protrusion 25 (FIG. 11) disposed on the frame 55 (FIG. 11). Accordingly, as shown in FIG. 15, the first structural member 43 and the second structural member 44 rotate around the rotational pivot 23 and open.

Figure 15:
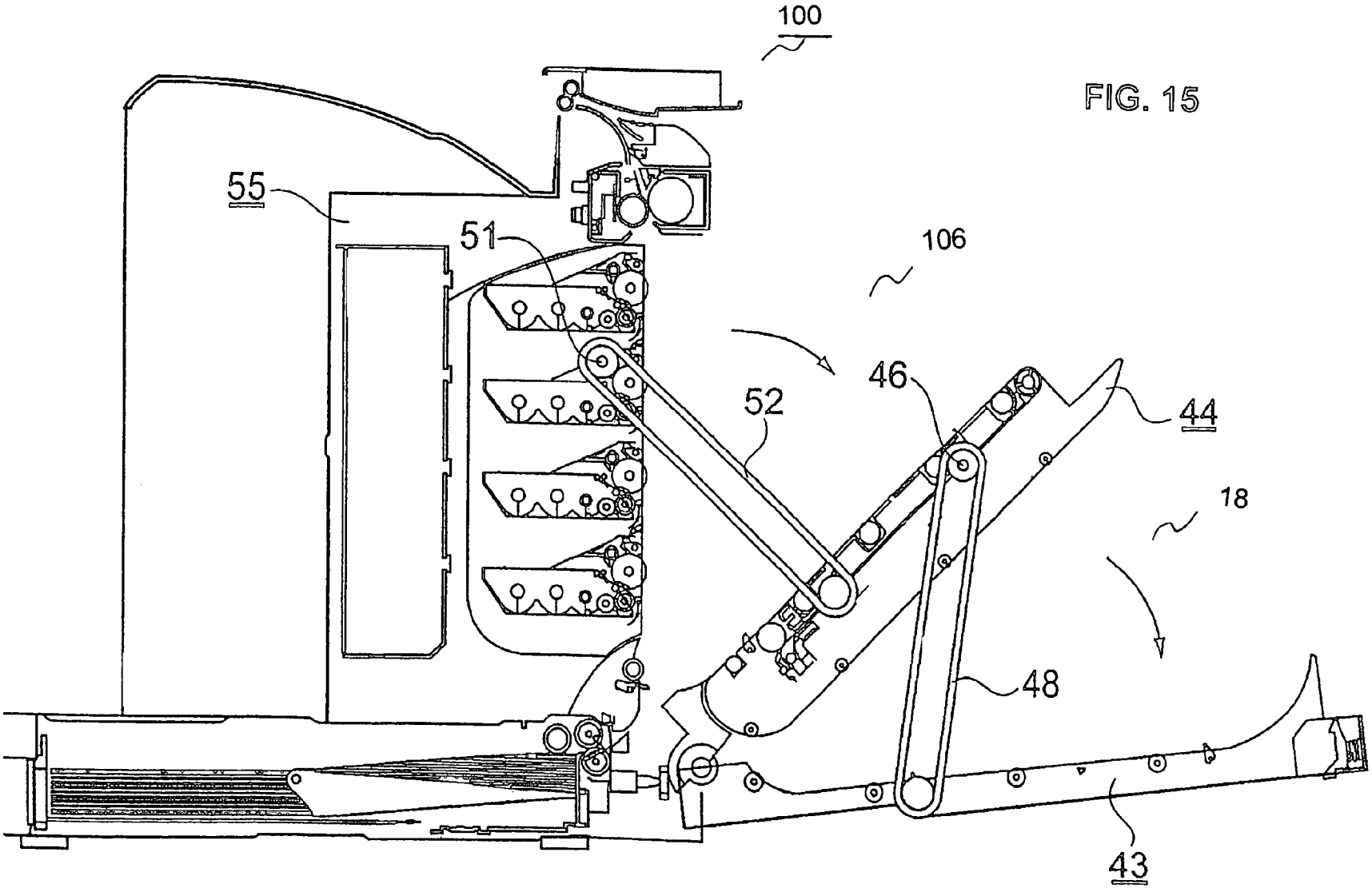
FIG. 15 is a sectional view showing an operation (No. 1) of the image forming device according to the third embodiment of the present invention.

As shown in FIG. 15, in the second structural member 44, the electromagnetic clutch 51 rotates freely, so that the link 52 slides and an end portion of the link 52 rotates until the end portion abuts against the gear of the electromagnetic clutch 51. In the first structural member 43, the electromagnetic clutch 46 rotates freely, so that the link 48 slides and an end portion of the link 48 rotates until the end portion abuts against the gear of the electromagnetic clutch 46. As a result, the frame 55, the first structural member 43, and the second structural member 44 are opened in the separated state, respectively. Accordingly, when the jams occur both between the developing units 9 (FIG. 11) and the transfer belt 11 (FIG. 11) and in the duplex transport path 18 (FIG. 11), the locations of the jams where the printing sheets P0 and P1 remain are opened to a large extent with the single handle operation, thereby making it easy to find the jammed sheets and recover the jams.

Step S3-5

Since the sensor 27 (FIG. 11) does not detect the printing sheet P1 within T1(s) since the sheet supply roller 4 starts rotating, it is determined that the jam occurs during the transportation and the printing sheet P1 remains in the image forming transport path 106 between the developing units 9 (FIG. 1) and the transfer belt 11 (FIG. 1). Also, it has passed T5(s) since the sensor 22-1 or the sensor 22-2 detects the printing sheet P0, so that it is determined that the printing sheet P0 does not remain in the duplex transport path 18 (FIG. 1). The control unit 101 stops the drive source 104 and the sheet supply drive source 107 to stop the image formation process, and energizes the electromagnetic clutch 46.

Step S3-6

Figure 16:
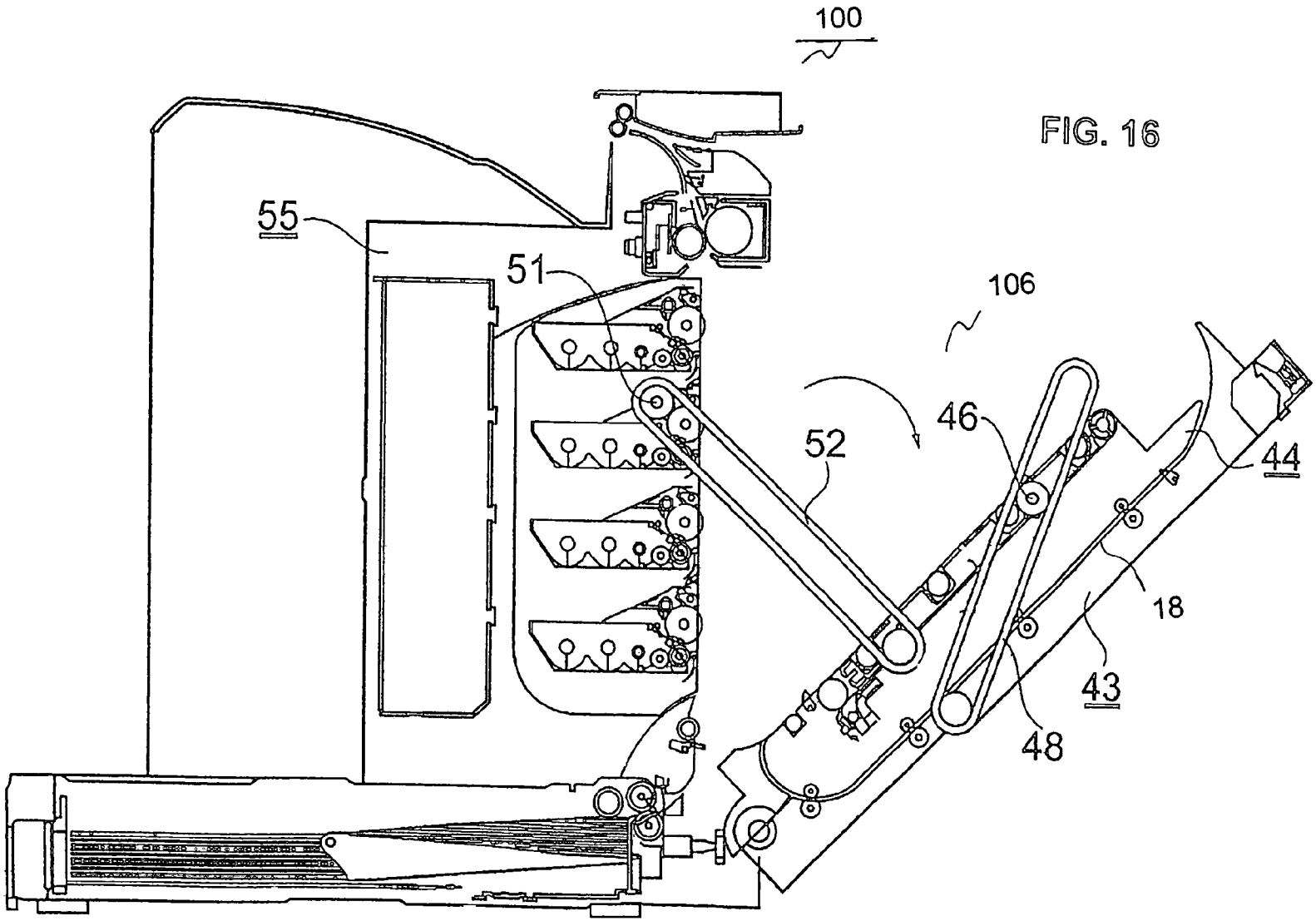
FIG. 16 is a sectional view showing an operation (No. 2) of the image forming device according to the third embodiment of the present invention.

The control unit 101 controls the display unit 102 to display the occurrence of the jam to notify and requests the operator to remove the jammed sheet P1. When the operator pulls up the handle 24 (FIG. 11) to remove the jammed sheet, the handle 24 (FIG. 11) is released from the protrusion 25 (FIG. 11) disposed on the frame 55 (FIG. 11). Accordingly, the first structural member 43 and the second structural member 44 rotate around the rotational pivot 23 and open shown in FIG. 16. As shown in FIG. 16, the gear of the electromagnetic clutch 46 does not rotate, so that the link 48 does not slide and is fixed. Therefore, the first structural member 43 and the second structural member 44 are integrated. Accordingly, when the jam occurs only between the developing units 9 (FIG. 11) and the transfer belt 11 (FIG. 11), the location of the jam where the printing sheet P1 remains is opened to a large extent with the single handle operation, thereby making it easy to find the jammed sheet and recover the jam.

Step S3-7

When the sensor 38 (FIG. 11) does not detect the printing sheet P1 within T2(s), it is determined that the jam occurs during the transportation between the developing units 9 (FIG. 11) and the transfer belt 11 (FIG. 11) and the printing sheet P1 remains in the image forming transport path 106 between the developing units 9 (FIG. 11) and the transfer belt 11 (FIG. 11). Accordingly, similar to step S3-2 when the sensor 27 (FIG. 11) does not detect the printing sheet P1 within T1(s) since the sheet supply roller 4 starts rotating, the process proceeds to steps S3-4 or S3-5 through step S3-3 to recover the jam. When the sensor 38 (FIG. 11) detects the printing sheet P1 within T2(s), the process proceeds to step S3-8.

Step S3-8

When the image forming device is not performing the duplex printing (printing one side), the process proceeds to step S3-9. When the image forming device is performing the duplex printing, the process proceeds to step S3-11.

Step S3-9

When there is next print data, the process proceeds to step S3-10. When there is no print data, the process stops.

Step S3-10

The control unit 101 resets the timer 103 to zero, and the process returns to step S3-1 for starting the next printing process.

Step S3-11

In a case that the duplex printing needs to be performed and both sides are printed, the process proceeds to step S3-9, so that the process of printing one side in step S3-8 is performed. On the other hand, in a case that the duplex printing needs to be performed and only one side is printed, the process proceeds to step S3-12.

Step S3-12

When the sensor 22-1 (FIG. 11) does not detect the printing sheet P within T3(s) since the sheet supply roller 4 starts rotating, the process proceeds to step S3-13. When the sensor 22-1 detects the printing sheet P, the process proceeds to step S3-17.

Step S3-13

When it is within T6(s) since the sensor 27 or the sensor 38 detects the printing sheet P2, the process proceeds to step S3-14, otherwise proceeds to step S3-15.

Step S3-14

Since the sensor 22-1 (FIG. 11) does not detect the printing sheet P1 within T3(s) since the sheet supply roller 4 starts rotating, it is determined that the jam occurs in the duplex transport path 18 (FIG. 11) and the printing sheet P1 remains in the duplex transport path 18 (FIG. 11). Further, since it is within T6(s) since the sensor 27 (FIG. 11) or the sensor 38 (FIG. 11) detects the printing sheet P2, it is determined (regardless of the occurrence of the jam) that the printing sheet P2 still remains in the image forming transport path 106 between the developing units 9 (FIG. 11) and the transfer belt 11 (FIG. 11). The control unit 101 stops the drive source 104 and the sheet supply drive source 107 to stop the image formation process, and controls the electromagnetic clutches 46 and 51 to be in the non-energized state, respectively.

The control unit 101 controls the display unit 102 to display the occurrence of the jam to notify and requests the operator to remove the jammed sheet (printing sheet P). In this state, the second structural member 43, the second structural member 44, and the frame 55 are separated. When the operator pulls up the handle 24 (FIG. 11) to remove the jammed sheet, the handle 24 (FIG. 11) is released from the protrusion 25 (FIG. 11) disposed on the frame 55 (FIG. 11). Accordingly, as shown in FIG. 15, the first structural member 43 and the second structural member 44 rotate around the rotational pivot 23 and open.

As shown in FIG. 15, in the second structural member 44, the electromagnetic clutch 51 rotates freely, so that the link 52 slides and the end portion of the link 52 rotates until the end portion abuts against the gear of the electromagnetic clutch 51. In the first structural member 43, the electromagnetic clutch 46 rotates freely, so that the link 48 slides and the end portion of the link 48 rotates until the end portion abuts against the gear of the electromagnetic clutch 46. As a result, the frame 55, the first structural member 43, and the second structural member 44 are opened in the separated state, respectively. Accordingly, when the jams occur both between the developing units 9 (FIG. 11) and the transfer belt 11 (FIG.

11) and in the duplex transport path 18 (FIG. 11), the locations of the jams where the printing sheets P0 and P1 remain are opened to a large extent with the single handle operation, thereby making it easy to find the jammed sheets and recover the jams.

Step S3-15

Since the sensor 22-1 (FIG. 11) does not detect the printing sheet P1 within T3(s) since the sheet supply roller 4 starts rotating, it is determined that the jam occurs in the duplex transport path 18 (FIG. 11) and the printing sheet P1 remains in the duplex transport path 18 (FIG. 1). Also, it has passed T6(s) since the sensor 27 or the sensor 38 detects the printing sheet P2, so that it is determined that the printing sheet P2 does not remain in the image forming transport path 106 between the developing units 9 (FIG. 11) and the transfer belt 11 (FIG. 1). The control unit 101 stops the drive source 104 and the sheet supply drive source 107 to stop the image formation process, and energizes the electromagnetic clutch 51 (FIG. 11).

Step S3-16

Figure 17:
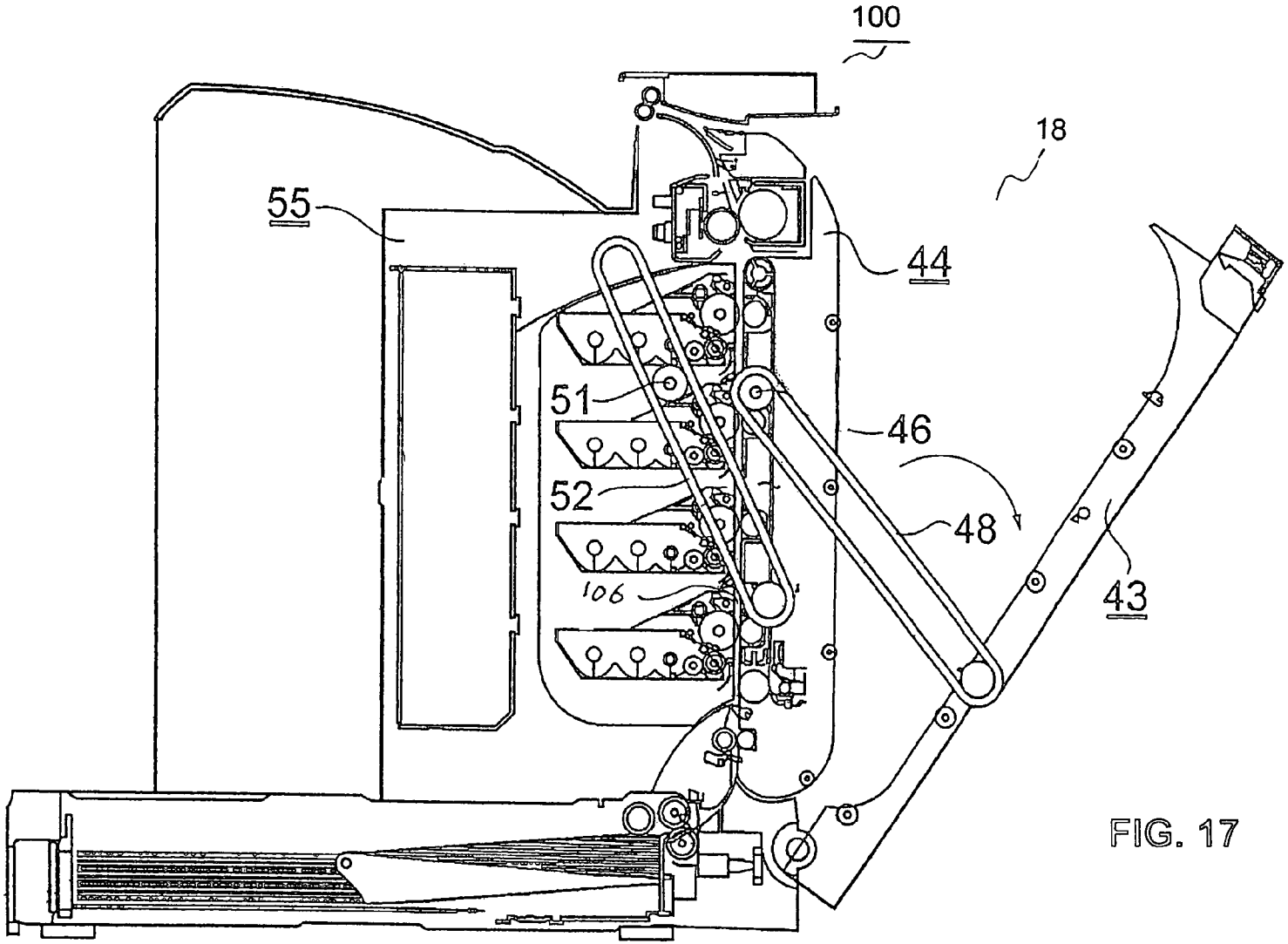
FIG. 17 is a sectional view showing an operation (No. 3) of the image forming device according to the third embodiment of the present invention.

The control unit 101 controls the display unit 102 to display the occurrence of the jam to notify and requests the operator to remove the jammed sheet. When the operator pulls up the handle 24 (FIG. 11) to remove the jammed sheet, the handle 24 (FIG. 11) is released from the protrusion 25 (FIG. 11) disposed on the frame 55 (FIG. 11). Accordingly, the first structural member 43 (FIG. 11) rotates around the rotational pivot 23 (FIG. 11) and opens as shown in FIG. 17. As shown in FIG. 16, the gear of the electromagnetic clutch 51 does not rotate, so that the link 52 does not slide and is fixed. Therefore, the second structural member 44 and the frame 55 are integrated. Accordingly, when the jam occurs between the developing units 9 (FIG. 11) and the transfer belt 11 (FIG. 11), the location of the jam where the printing sheet P1 remains is opened to a large extent with the single handle operation, thereby making it easy to find the jammed sheet and recover the jam.

Step S3-17

When the sensor 22-2 (FIG. 11) does not detect the printing sheet P1 within T4(s), it is determined that the jam occurs during the transportation in the duplex transport path 18 (FIG. 11) and the printing sheet P1 remains in the duplex transport path 18 (FIG. 11). Accordingly, similar to step S3-12 when the sensor 22-1 (FIG. 11) does not detect the printing sheet P1 within T3(s) since the sheet supply roller 4 starts rotating, the process proceeds to steps S3-14 or S3-15 through step 3-13 to recover the jam. When the sensor 22-2 (FIG. 11) detects the printing sheet P1 within T4(s), the process proceeds to step S3-18.

Step S3-18

The control unit 101 resets the timer 103 to zero, and the process returns to step S3-2 for starting the next printing process.

As described above, the jam location where the printing sheet remains is detected and the structural members are connected or opened. Accordingly, when the jams occur at several locations, or the jam occurs at one location and the printing sheet at other location needs to be removed, it is easy to find the jammed sheet and recover the jam similar to the second embodiment with the simple structure having a small number of components.

In the embodiments, the image forming device is applied to the printer, and the invention is not limited thereto. The image forming device is applicable to a fax machine, a copier, and a plotter.

The disclosure of Japanese Patent Application No. 2004-217454, filed on Jul. 26, 2004, is incorporated in the application.

While the invention has been explained with reference to the specific embodiments of the invention, the explanation is illustrative and the invention is limited only by the appended claims.

What is claimed is:

1. An image forming device for forming an image on a medium, comprising:

a transport path including a plurality of structural members connected with each other, said structural members having a common rotational pivot so that the structural members rotate in a same direction;

a plurality of dividing and opening devices for dividing the transport path into the structural members and opening the transport path;

a plurality of jam detection devices disposed along the transport path for detecting a jam; and a dividing and opening control device for selecting at least one of the dividing and opening devices so that the transport path is divided and opened according to a location of the jam detected by at least one of the jam detection devices while maintaining a state that the structural members are connected.

2. An image forming device according to claim 1, wherein said dividing and opening control device includes an all releasing device for releasing all of the structural members when at least one of the jam detection devices detects the jam.

3. An image forming device according to claim 1, wherein each of said dividing and opening devices includes a solenoid and a latch so that the latch engages and is released when the solenoid moves reciprocally.

4. An image forming device according to claim 1, wherein each of said dividing and opening devices includes a link slidably connecting the structural members and an electromagnetic clutch for controlling the link to slide.

5. An image forming device according to claim 1, wherein said transport path includes a first transport path, a second transport path, and a transport selection unit disposed on a downstream side of the first transport path in a direction that the medium is transported for guiding the medium to the second transport path or outside.

6. An image forming device according to claim 5, further comprising a merging unit disposed on an upstream side of the first transport path and connected to the second transport path.

7. An image forming device according to claim 1, further comprising a handle disposed on at least one of the structural members, an engaging unit for engaging the at least one of the structural members with other structural members, and a releasing unit connected to the handle for releasing the engaging unit.

8. An image forming device for forming an image on a medium, comprising:

a main body unit;

an image forming unit disposed in the main body unit;

a first structural member capable of dividing and moving relative to the image forming device;

a second structural member capable of dividing and moving relative to the main body unit and the first structural member;

a first transport path situated between the first structural member and the second structural member;

a second transport path situated between the second structural path and the image forming device;

a sensor for detecting the medium;

a first engaging unit for engaging the first structural member with the second structural member;

a second engaging unit for engaging the second structural member with the main body unit; and a control unit for sending a signal to at least one of the first engaging unit and the second engaging unit to release an engagement thereof based on a medium detection result of the sensor.

9. An image forming device according to claim 8, further comprising a timer electrically connected to the control unit, said sensor including a first transport path sensor disposed in the first transport path, said control unit sending the signal to the first engaging unit to engage when the medium passes through the first transport path sensor within a predetermined period of time.

10. An image forming device according to claim 8, further comprising a medium placing unit for placing the medium and a sheet supply unit for supplying the medium, said sensor including a second transport path sensor disposed on a downstream side of the second transport path, said control unit sending the signal to the second engaging unit to release the engagement thereof when the medium does riot pass through the second transport path sensor within a predetermined period of time after the sheet supply unit starts supplying the medium.

11. An image forming device according to claim 8, further comprising a medium placing unit for placing the medium and a sheet supply unit for supplying the medium, said sensor including a second transport path sensor disposed on a downstream side of the second transport path, said control unit sending the signal to the second engaging unit to engage when the medium passes through the second transport path sensor within a first predetermined period of time after the sheet supply unit starts supplying the medium.

12. An image forming device according to claim 11, wherein said sensor includes a first transport path sensor disposed in the first transport path, said control unit sending the signal to the first engaging unit to release the engagement thereof when the medium does not pass through the first transport path sensor within a second predetermined period of time.

13. An image forming device according to claim 8, further comprising a transport selection unit disposed on a downstream side of the first transport path for guiding the medium to the second transport path or outside.

14. An image forming device according to claim 8, further comprising a merging unit disposed on an upstream side of the first transport path and connected to the second transport path.

15. An image forming device according to claim 8, further comprising a third engaging unit for engaging the first structural member with the main body unit, a handle disposed on the first structural member, and a releasing unit connected to the handle for releasing the third engaging unit.

16. An image forming device according to claim 8, wherein said first structural member and said second structural member have a common rotational pivot so that the first structural member and the second structural member rotate in a same direction.

* * * * *